US006105523A

United States Patent [19]

Tanaka et al.

[11] Patent Number: 6,105,523

[45] Date of Patent: Aug. 22, 2000

[54] BELT-LOOP SUPPLY APPARATUS

[75] Inventors: Makoto Tanaka; Noriyuki Hirose; Akira Maeda; Masahiko Tanaka; Kenji Kitada; Hiroyuki Kazehare, all of Tokyo, Japan

[73] Assignee: Juki Corporation, Tokyo, Japan

[21] Appl. No.: 09/210,360

[22] Filed: Dec. 11, 1998

[30] Foreign Application Priority Data

Dec. 15, 1997 [JP] Japan ..... 9-345248

[51] Int. Cl.[7] ..... D05B 35/06

[52] U.S. Cl. ..... 112/470.34; 112/475.13

[58] Field of Search ..... 112/470.34, 470.33, 112/475.06, 104, 147, 152, 475.13, 470.03

[56] References Cited

U.S. PATENT DOCUMENTS 5,513,590 5/1996 Allison et al. ..... 112/470.34 X 5,588,384 12/1996 Miyachi et al. ..... 112/475.06

5,673,639 10/1997 Miyachi et al. ..... 112/470.34

*Primary Examiner*—Peter Nerbun

*Attorney, Agent, or Firm*—Morgan & Finnegan LLP

[57] ABSTRACT

A belt-loop supply apparatus incorporating a tape supply unit which is capable of supplying, to a tape cutting position, an elongated tape for forming a belt loop; a tape cutting unit for cutting the tape supplied to the tape cutting position to form a belt loop having a predetermined length; and a belt loop supply unit incorporating a pair of bending members for holding two ends of the cut belt loop, bending the two ends of the belt loop toward the central portion of the belt loop and supplying the belt loop, the belt-loop supply apparatus having: a moving unit for controlling moving speed of the bending members to move the bending members to a sewing position of a machine.

13 Claims, 19 Drawing Sheets

BELT-LOOP SUPPLY APPARATUS

BACKGROUND OF THE INVENTION

1. Field of the Invention

The present invention relates to a belt-loop supply apparatus, and more particularly to a belt-loop supply apparatus which is capable of reliably and stably supplying, to a sewing position, a belt loop formed into a predetermined shape.

2. Related Background Art

Belt-loop sewing machines have been suggested each of which is capable of sewing a multiplicity of belt loops, through which a belt is inserted, to the waist portions of a variety of sewn products, such as jeans, pairs of pants and skirts. The belt-loop sewing machine is provided with a belt-loop supply apparatus which is capable of automatically supplying a belt loop to a sewing position of the belt-loop sewing machine.

FIGS. 20 and 21 are diagrams showing an example of a belt-loop supply apparatus provided for a conventional belt-loop sewing machine. An apparatus of the foregoing type has been disclosed in, for example, U.S. Pat. No. 5,673,639. The conventional belt-loop supply apparatus 1 is disposed beside a body 2A of a belt-loop sewing machine 2 which is a sewing means.

The body 2A is, for example, twin-needle cycle machine having a bed 3 disposed in a lower portion thereof. Moreover, an arm 4 paralleling the bed 3 is disposed in an upper portion of the body 2A. Two needles 5 paralleling the lengthwise direction of the arm 4 is disposed at a required position on the lower surface of a free end of the arm 4 which is called a machine head. Each of the needles 5 is joined to a known needle bar 28 (see FIG. 21) which is capable of performing a reciprocating motion for a predetermined vertical stroke by a known needle-bar operation mechanism. The needle-bar operation mechanism is operated in synchronization with the rotation of an upper shaft which is rotated by a machine motor (not shown) rotatively disposed in the arm 4. A known cloth retaining unit (not shown) is disposed at a required position of the arm 4, the cloth retaining unit incorporating two cloth retainers 7 permitted to be moved vertically and structured to retain sewn product S on an upper surface of a needle plate 6 on the upper surface of the bed 3 during a sewing operation.

The belt-loop supply apparatus 1 incorporates a tape supply means 8, a tape bringing/holding means 9, a tape cutting means 10 and a loop supply means 11.

The tape supply means 8 is provided for the purpose of supplying, to a belt-loop forming position adjacent to a sewing position of the body 2A, an elongated tape 12 for forming belt loops. As shown in FIG. 20, a tape delivery frame 13 is disposed on the right side of the body 2A to substantially parallel the bed 3. The tape 12 is placed on the upper surface of the tape delivery frame 13. A delivery roller 14 is disposed above the tape delivery frame 13 so as to deliver the tape 12 for a predetermined length toward the belt-loop forming position. The delivery roller 14 can be brought into contact with the upper surface of the tape 12. The delivery roller 14 can be rotated by a tape delivering motor (not shown).

The tape bringing/holding means 9 brings, to a predetermined position, an end of the tape 12 supplied to the belt-loop forming position, that is, the right-hand end of the tape 12 shown in the right-hand portion of each of FIGS. 20 and 21. Then, the tape bringing/holding means 9 holds the right-hand end of the tape 12 at the predetermined position. The tape bringing/holding means 9 incorporates guide rods 17 for, bringing, to abutting members 16, the tape 12 supplied to the upper surfaces of stationary receiving plates 15. In addition, the tape bringing/holding means 9 incorporates compression coil springs 18 for holding, on the receiving plates 15, the tape 12 brought to the abutting members 16. The guide rods 17 and the compression coil springs 18 can be moved vertically by tape-bringing/holding operation means 19 comprising air cylinders.

The tape cutting means 10 cuts the tape 12 held on the receiving plates 15 by the tape bringing/holding means 9 at the base portion thereof to form a belt loop 20 having a predetermined length. The tape cutting means 10 has a movable blade 21 disposed above a front end of the tape delivery frame 13. The movable blade 21 is, by a tape-cutting operation means comprising an air cylinder (not shown), enabled to perform a reciprocating motion in the vertical direction. In cooperation with a stationary blade 29 (see FIGS. 22 and 23) disposed below the movable blade 21, the movable blade 21 cuts the tape 12.

The loop supply means 11 folds the two ends of the belt loop 20 cut to have the predetermined length toward the central portion of the belt loop 20 so as to bring the two ends to the sewing position of the body 2A below the needle 5. The loop supply means 11 incorporates a pair of bending shafts 22 each of which is called a fork having forked leading ends. The base portions of the bending shafts 22 are, as shown in FIG. 21, connected to bent shaft operation means 23 (see FIG. 21) comprising rotary cylinders which are independently disposed at the lower ends of a seesaw guide lever 25 rotatively supported by a movable bracket 24. The movable bracket 24 is connected to a bent shaft moving means 26 substantially horizontally disposed above the movable bracket 24 and comprising three-stage air cylinder. When the bent shaft moving means 26 is operated, the movable bracket 24 can be moved to and from the sewing position.

The operation of the conventional belt-loop supply apparatus 1 structured as described above will now be described. Initially, the tape 12 is delivered from the tape delivery frame 13 to the belt-loop forming position by dint of rotations of the delivery roller 14. Then, the tape 12 is supported by the receiving plates 15 from lower positions. When the tape 12 has been supplied to the upper surfaces of the receiving plates 15, the tape-bringing/holding operation means 19 are turned on so that the guide rods 17 and the compression coil springs 18 are moved downwards. Then, the tape 12 is, by the guide rods 17, brought to the positions of the abutting members 16. Then, the tape 12 is pressed and held by the compression coil springs 18. Then, as shown in FIG. 22, the bent shaft moving means 26 is operated so that the bending shafts 22 are, together with the movable bracket 24, forwards moved toward the tape 12 positioned at the belt-loop forming position. Then, the forked leading ends of the bending shafts 22 are inserted into portions adjacent to the two ends of the tape 12 removed from the receiving plates 15.

Then, as shown in FIG. 23, the tape-cutting operation means (not shown) is operated so that the movable blade 21 is moved downwards. Thus, the movable blade 21 cuts the base portion of the tape 12 in cooperation with the stationary blade 29. Thus, a belt loop 20 having a predetermined length is formed. Then, the bent shaft operation means 23 are operated so that the bending shafts 22 are rotated outwardly as indicated by an arrow A shown in FIG. 23. As a result, the two ends of the belt loop 20 are downwards folded toward the central portion of the belt loop 20. That is, the belt loop 20 is folded by about 180°. At this time, either side surface of the tape 12 has been brought into contact with the abutting members 16 and positioned at a predetermined position by the tape bringing/holding means 9. Therefore, when the two ends of the belt loop 20 cut to have the predetermined length are folded by the bending shafts 22, devastation of the bent portions can be prevented. That is, the two ends can completely be laid to overlap each other.

Then, as shown in FIG. 24, the tape-bringing/holding operation means 19 are operated so that the guide rods 17 and the compression coil springs 18 are moved upward. Thus, the state in which the belt loop 20 is held by the receiving plates 15 and the compression coil springs 18 is suspended.

Then, the bent shaft moving means 26 is operated so that the bending shafts 22 are, together with the movable bracket 24, forwards moved to positions on this side of the sewing position, as shown in FIG. 21. Specifically, the bending shafts 22 and the movable bracket 24 are moved to positions above the side end of the needle plate 6 of the belt-loop sewing machine 2. Thus, the belt loop 20 having the two folded ends is made to be on standby.

Then, an operator positions the sewn product S at a predetermined position on the needle plate 6, and then the operator switches on a loop supply switch 27 (see FIG. 21). Thus, the bent shaft moving means 26 is operated so that the movable bracket 24 are, together with the movable bracket 24, forwards moved toward the sewing position. As a result, the belt loop 20 having the two folded ends is brought to the sewing position. Specifically, the belt loop 20 is moved to a position below the cloth retainers 7.

Then, the cloth retainers 7 are moved downwards to hold the two folded portions of the belt loop 20. Then, the bent shaft moving means 26 is operated so that the bending shafts 22 are moved rearwards together with the movable bracket 24. Then, the leading ends of the forked bending shafts 22 are removed from the two folded portions of the belt loop 20. Then, for example, the two side portions of the belt loop 20 in the lengthwise direction of the belt loop 20 are sewn in accordance with a predetermined sewing pattern. Thus, the belt loop 20 can be sewn to a predetermined position of the sewn product S.

After the bending shafts 22 have been moved rearwards, the bent shaft operation means 23 are operated. Thus, the bending shafts 22 are reversely rotated so that the bending shafts 22 are restored to the initial positions. Then, a similar operation is performed so that a belt loop 20 for use in a next sewing operation is formed. The formed belt loop 20 is made to be on standby at a position on this side of the sewing position.

At the present time, high-quality products sewn satisfactorily are required. To improve the quality of the belt loop 20 which is sewn to the waist portion of the sewn product S by the belt-loop sewing machine, a belt-loop supply apparatus which is capable of reliably and stably supplying the belt loop 20 to the sewing position has been required.

That is, a belt-loop supply apparatus which is capable of reliably and stably supplying the belt loop 20 having a predetermined shape to the sewing position has been required.

SUMMARY OF THE INVENTION

In view of the foregoing, an object of the present invention is to provide a belt-loop supply apparatus which is capable of reliably and stably supplying a belt loop having a predetermined shape to a sewing position.

According to one aspect of the present invention, there is provided a belt-loop supply apparatus comprising moving means which is capable of changing moving speed to move the bending member to a sewing position of a machine or moving means joined to the bending shafts and capable of changing moving speed of the bending shafts in the axial direction.

As a result of employment of the above-mentioned structure, the pair of the bending members (shafts) can easily be moved at high speed. Moreover, the speed of the pair of the bending members immediately before stoppage can easily be decelerated. As a result, great noise, such as impact sound and operation sound, can be prevented. Thus, the environment for the operation can be improved. Moreover, operation timing can appropriately be controlled.

According to another aspect of the present invention, there is provided a belt-loop supply apparatus comprising moving means joined to the bending shafts and capable of changing moving speed of the bending shafts in the axial direction such that the bending shafts are stopped at an arbitrary position after movement of the bending shafts.

As a result of employment of the above-mentioned structure, the pair of the bending shafts can be stopped at arbitrary positions. Therefore, the position of the belt loop which has been supplied to the sewing position of the machine for sewing the belt loop can easily be adjusted. As a result, if the width of the belt loop is changed, sewing of the belt loop and offset sewing of the belt loop can easily be performed without a necessity of changing the distance from the loop supply means to the sewing position, that is, without a necessity of changing the position of the loop supply means.

Other objects, features and advantages of the invention will be evident from the following detailed description of the preferred embodiments described in conjunction with the attached drawings.

DESCRIPTION OF THE PREFERRED EMBODIMENTS

Figure 1:
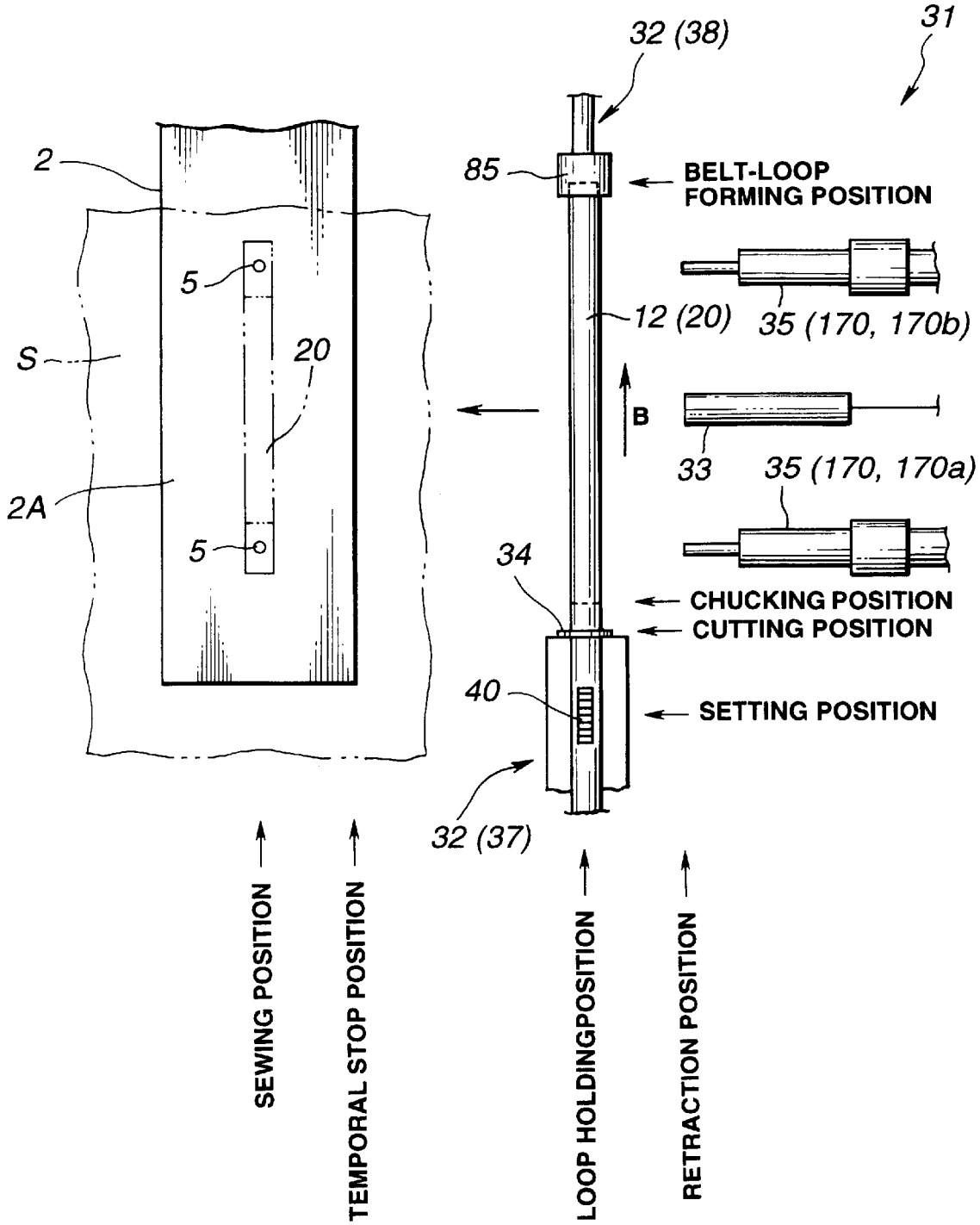
FIG. 1 is a schematic view showing an essential portion of a first embodiment of a belt-loop supply apparatus according to the present invention such that also a machine for sewing a belt loop is illustrated.

Embodiments of the present invention will now be described with reference to the drawings. Note that the same or similar elements to those of the conventional structure are given the same reference numerals.

FIG. 1 shows an essential portion of a first embodiment of a belt-loop supply apparatus according to the present invention such that a belt loop sewing machine is also illustrated.

A belt-loop supply apparatus 31 according to this embodiment is provided for a belt-loop sewing machine 2 for sewing a belt loop 20 to a sewn product S, for example, jeans. As shown in FIG. 1, the belt-loop supply apparatus 31 incorporates a tape supply means 32, a tape bringing means 33, a tape cutting means 34 and a loop supply means 35. The tape supply means 32 of the belt-loop supply apparatus 31 moves an elongated tape 12 for forming a belt loop to a belt-loop forming position on the right-hand side (in FIG. 2) of the body 2A of the belt-loop sewing machine 2, the belt-loop forming position being adjacent to a sewing position of a body 2A of the belt-loop sewing machine 2. The tape 12 is moved from a front portion in a lower portion in FIG. 1 to an inward position shown in an upper portion in FIG. 1 (in a direction indicated with an arrow B shown in FIG. 1). Then, the tape 12 is positioned at a predetermined position by the tape bringing means 33. Then, the tape cutting means 34 cuts the base portion so that the belt loop 20 having a predetermined length is formed. Moreover, the loop supply means 35 folds the two ends of the belt loop 20 positioned at the belt-loop forming position toward the center of the belt loop 20. Then, the loop supply means 35 moves the belt loop 20 to the sewing position.

The tape supply means 32 will now be described further in detail with reference to FIG. 2.

The tape supply means 32 delivers the elongated tape 12 for forming a belt loop so as to supply the tape 12 to the belt-loop forming position. As shown in FIG. 2, the tape supply means 32 incorporates a tape delivery means 37 and a tape drawing means 38 disposed opposite to each other such that the tape delivery means 37 and the tape drawing means 38 are positioned away from each other for an appropriate distance.

The tape delivery means 37 delivers the tape 12 toward the belt-loop forming position (in a direction indicated by the arrow B). The tape delivery means 37 incorporates a delivery roller 40 having an outer surface provided with a plurality of teeth (not shown) for effectively delivering the tape 12. The delivery roller 40 is, through a one-way clutch 41, joined to an end of a rotary shaft 42 disposed substantially horizontally to be perpendicular to the direction in which the tape 12 is delivered. A follower timing belt pulley 43 is joined to another end (an inward position in FIG. 2) of the rotary shaft 42. The follower timing belt pulley 43 is, by a timing belt 46, connected to a drive timing belt pulley 45 joined to an output shaft 44*a* of a tape delivery motor 44 comprising a stepping motor. Thus, the rotation of the delivery roller 40 is permitted. Moreover, the tape delivery motor 44 is electrically connected to a control means 210 (see FIG. 15) to be described later so as to be operated at predetermined timing in accordance with a control command issued from the control means 210.

A tape delivery frame 48 provided with a flat tape-delivery surface 47 on which the tape 12 can be placed is disposed below the delivery roller 40. The tape delivery frame 48 is supported by a delivery-frame holder 49 disposed below the tape delivery frame 48 such that the tape-delivery surface 47 is positioned substantially horizontally. The delivery-frame holder 49 is joined to a holder support member 52 disposed below the delivery-frame holder 49 such that the position of the delivery-frame holder 49 with respect to the direction in which the tape 12 is delivered can be adjusted. The holder support member 52 is joined to an upper portion of a delivery frame 53 stood erect on the right side (in FIG. 2) of the supply frame 36.

The tape cutting means 34 is disposed at a position adjacent to the leading end of the delivery roller 40 downstream of the direction in which the tape 12 is moved. The tape cutting means 34 cuts the base portion of the tape 12 which is an upstream position in the direction of the movement of the tape 12. The tape cutting means 34 cuts the tape 12 at a predetermined position adjacent to the leading end of the tape delivery frame 48. Thus, a belt loop 20 having a predetermined length is formed. The tape cutting means 34 incorporates a movable blade 34*a* which is disposed above a passage for the tape 12 in a usual state and which can be moved vertically by a cutting-operation driving means 61 comprising an air cylinder. Moreover, the tape cutting means 34 incorporates a stationary blade 34*b* disposed substantially opposite to the movable blade 34*a* at a position below the passage for the tape 12 such that the stationary blade 34*b* faces the passage for the tape 12. The cutting-operation driving means 61 is operated by a cutting-operation driving electromagnetic valve 62 (see FIG. 15) corresponding to a control means 210 (see FIG. 15) to be described later. Moreover, the cutting-operation driving means 61 is operated at predetermined timing in accordance with a control command issued from the control means 210 to the cutting-operation driving electromagnetic valve 62. In addition, the tape cutting means 34 incorporating the movable blade 34*a*, the stationary blade 34*b* and the cutting-operation driving means 61 is supported on the side surface of the delivery-frame holder 49 through a female bracket 63. Therefore, a predetermined distance from the cutting position to the delivery roller 40 can always be maintained. The tape cutting means 34 is moved simultaneously with the movement of the tape delivery means 37 when the position of the tape delivery means 37 has been adjusted in the delivery direction of the tape 12.

Figure 2:
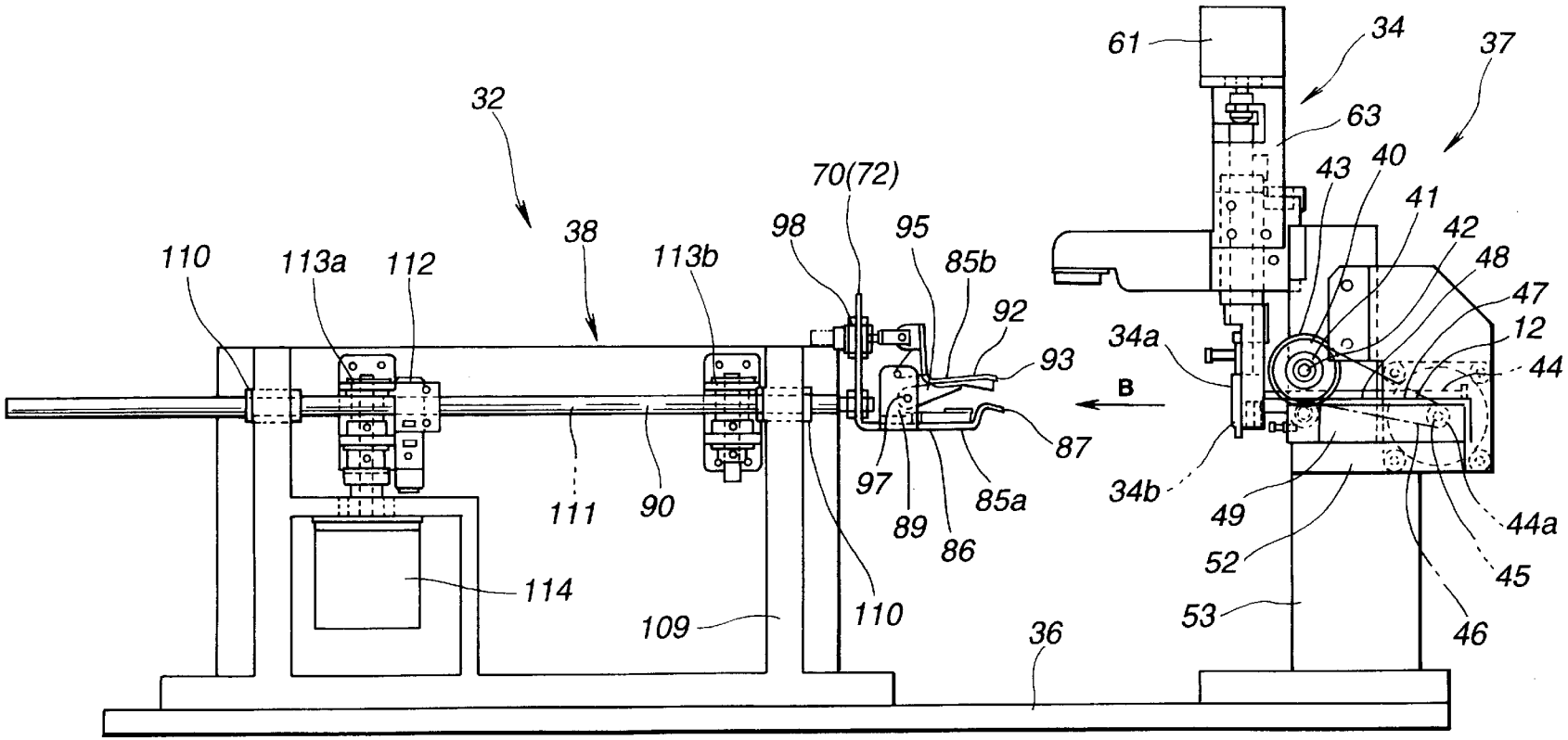
FIG. 2 is a front view showing a tape supply means and a tape cutting means.

The tape drawing means 38 draws the tape 12 in a delivery direction which is the movement direction indicated by an arrow B shown in FIG. 2. The tape drawing means 38 is disposed at an inward position (in an upper portion in FIG. 1) of the body 2A such that the tape drawing means 38 is positioned at the most downstream position (in an upper position in FIG. 1 and in a left-hand position in FIG. 2) in the delivery direction of the tape 12 with respect to the tape delivery means 37. The tape drawing means 38 incorporates a chucking arm 85 having a stationary arm 85*a* and a movable arm 85*b* for holding the leading end of the tape 12.

The stationary arm 85*a* shown in a lower portion in FIG. 2 has a base 86 formed into an L-like flat shape. A chuck 87 is formed on the right-hand side (in FIG. 2) of the base 86. The chuck 87 is substantially flush with the lower surface of the tape 12 or somewhat lower than the lower surface to permit the tape 12 to be placed. A pair of side plates 89 (only one of the side plates 89 is shown) are stood erect at the lower end of the base 86 such that the side plates 89 are positioned opposite to each other. The leading end of a drive rod 90 for substantially horizontally moving the chucking arm 85 toward the leading end of the tape 12 is joined to the lower portion of the side surface of the base 86.

The movable arm 85*b* shown in an upper portion in FIG. 2 has an L-like flat base 92. A chuck 93 extending to the chuck 87 is formed adjacent to the leading end of the base 92 shown in a right-hand portion in FIG. 2. A link portion 95 is provided for the lower surface of the base 92. The link portion 95 is rotatively supported by a horizontal support shaft 97 which is supported by the side plates 89. An output shaft of an air cylinder 98 serving as an opening/closing means is joined to the side surface of the base 92. When the air cylinder 98 is operated, the base 92 pivots about the support shaft 97. Thus, the chuck 93 is allowed to approach the chuck 87 or moved away from the chuck 87. Moreover, the air cylinder 98 serving as the opening/closing means is operated by an opening/closing operating electromagnetic valve 100 (see FIG. 15) connected to a control means 210 (see FIG. 15) to be described later. Moreover, the air cylinder 98 is moved forwards/rearwards for a predetermined stroke at predetermined timing in accordance with a control command issued from the control means 210 to the opening/closing operating electromagnetic valve 100.

The drive rod 90 is supported by two bearings 110 joined to a drawing frame 109 stood erect on a left-hand side (in FIG. 2) of the supply frame 36 and formed into U-like shape facing side in a plan view. The drive rod 90 is supported in parallel with the delivery direction of the belt-loop sewing machine 2 such that a reciprocating motion of the drive rod 90 in the axial direction is permitted. A pair of timing belt pulleys 113*a* and 113*b* are disposed at an inward position (in FIG. 2) of the drive rod 90, the timing belt pulleys 113*a* and 113*b* being positioned adjacent to the bearings 110. A rod movement timing belt 111 is arranged between the timing belt pulleys 113*a* and 113*b* in parallel with the drive rod 90. The drive rod 90 is, by an appropriate securing member 112, secured to a position of the rod movement timing belt 111. The timing belt pulley 113*a* of the timing belt pulleys 113*a* and 113*b* shown in a left-hand portion in FIG. 2 is secured to a rotational shaft of a tape drawing motor 114 disposed below the timing belt pulley 113*a*. When the tape drawing motor 114 is rotated, the drive rod 90 is allowed to reciprocate. As a result, the pair of the chucking arms 85 move to and from the leading end of the tape 12. The tape drawing motor 114 is electrically connected to the control means 210 (see FIG. 15) to be described later so as to be rotated at predetermined timing in accordance with a control command issued from the control means 210.

The tape bringing means 33 will now be described further in detail with reference to FIGS. 1 to 3 and FIG. 12.

Figure 3:
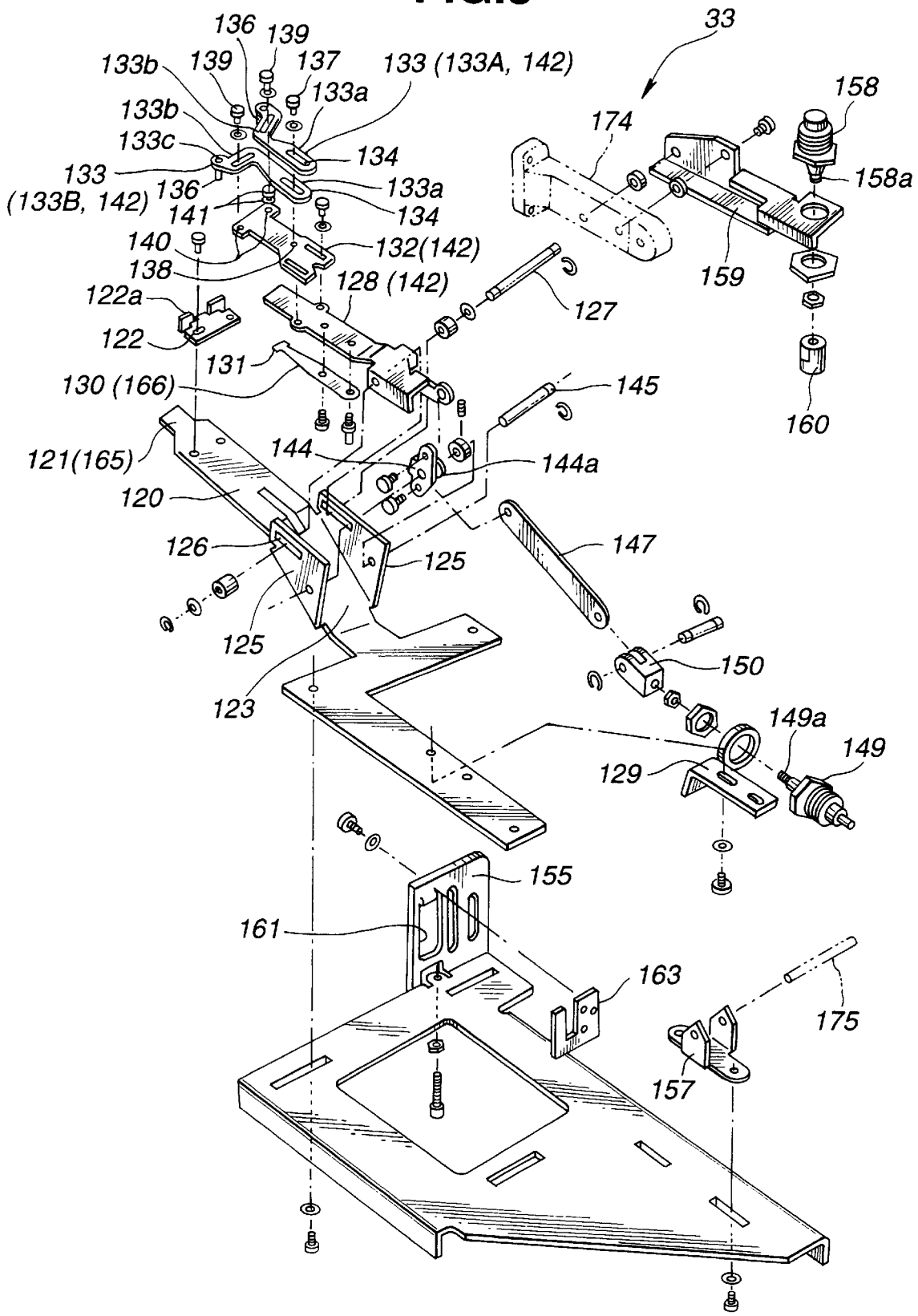
FIG. 3 is an exploded perspective view showing a tape bringing member.

The tape bringing means 33, from a lower position, supports the substantially central portion of the tape 12 in the lengthwise direction of the tape 12 supplied to the belt-loop forming position by the tape supply means 32. Moreover, the tape bringing means 33 brings the side of the tape 12, which is the right-hand side (in FIG. 1) of the tape 12, to a predetermined position. Then, the tape bringing means 33 aligns and holds the tape 12. As shown in FIG. 3, the tape bringing means 33 incorporates a tape support member 120. The upper surface of the leading end of the tape support member 120 shown in a diagonally upper portion in FIG. 3 is formed into a substantially flat tape receiving surface 121 for upwards supporting the lower surface of the tape 12 supplied to the belt-loop forming position. The tape receiving surface 121 has a plurality of positioning members 122, which are called abutting members and arranged to restrain the position of the tape 12 and each of which has an L-like cross sectional shape. The positioning members 122 are disposed from the leading end of the tape receiving surface 121 at predetermined intervals such that the positioning members 122 parallel the lengthwise direction of the tape 12 supplied to the belt-loop forming position. The positioning members 122 is provided with a contact surface 122*a* with which the right-hand side of the tape 12 in FIG. 1 can be brought into contact.

The base portion of the tape receiving surface 121 is connected to an L-like joining portion 124 through an inclined surface 123 bent diagonally downwards, the joining portion 124 extending substantially in parallel with the tape receiving surface 121. Moreover, a pair of guide support portions 125 bent upwards are provided at the two side ends of the inclined surface 123. The upper ends of the guide support portions 125 substantially parallel the tape receiving surface 121 such that the upper ends are higher than the tape receiving surface 121. Elongated holes 126, the lengthwise direction of each of which parallels the tape receiving surface 121, are formed adjacent to upper ends of the guide support portions 125 positioned upper than a plane including the tape receiving surface 121. Two ends of a bringing-board support shaft 127, which are capable of moving in the lengthwise directions of the elongated holes 126, are received in the elongated holes 126.

The base portion of the bringing board 128 is rotatively joined to the central portion of the bringing-board support shaft 127. That is, the base portion of the bringing board 128, which constitutes a portion of a tape bringing member 142 to be described later, is supported such that parallel translation and rotation of the base portion of the bringing board 128 are permitted. The base portion of a tape holding member 130 comprising an elastic member, such as a spring, is joined to the lower surface of the bringing board 128. That is, the tape holding member 130 is disposed opposite to the tape support member 120. A holding portion 131 (see FIGS. 6 and 7) projecting downwards is formed at the leading end of the tape holding member 130 in order to downwards hold the tape 12 placed on the tape receiving surface 121.

A plate-like bringing-board moving plate 132 is joined to the leading end portion of the upper surface of the bringing board 128 positioned in a diagonally upper left position in FIG. 3. The position, at which the bringing-board moving plate 132 is joined, can be adjusted in the lengthwise direction of the bringing board 128. A pair of tape bringing guides 133 formed into plate-like shapes are disposed on the upper surface of the bringing-board moving plate 132. The tape bringing guide 133A of the pair of the tape bringing guides 133 shown in the right-hand portion in FIG. 3 brings the leading end (in the upper portion in FIG. 1) of the tape 12 supplied to the belt-loop forming position. The tape bringing guide 133A incorporating a base 133Aa has elongated holes 134 penetrating the base 133Aa serving as a distance adjustment means and structured into a through hole formed in the direction of the thickness. Moreover, the tape bringing guide 133A incorporates a circular-arc portion 133Ab which extends from the right-hand side of the leading end of the base 133Aa which has a circular-arc elongated holes 135 serving as a movement locus control means and structured into a through hole formed in the direction of the thickness. In addition, the tape bringing guide 133A incorporates a pin joining portion 133Ac which extends from the left-hand side of the leading end of the circular-arc portion 133Ab and to which a bringing pins 136 serving as a bringing members are secured to the leading end thereof. The other tape bringing guide 133B of the pair of the tape bringing guides 133 shown in the left-hand portion in FIG. 3 brings the base portion (the lower portion in FIG. 1) of the tape 12 supplied to the belt-loop forming position. The tape bringing guide 133B incorporates a base 133Ba having elongated holes 134 serving as a distance adjustment means and structured into a through hole formed in the direction of the thickness. In addition, the tape bringing guide 133B incorporates a circular-arc portion 133Bb which extends from the left side of the leading end of the base 133Ba and which has a circular-arc elongated holes 135 serving as a movement locus control means and structured into a through hole formed in the direction of the thickness. In addition, the tape bringing guide 133B incorporates a pin joining portion 133Bc which extends from the right side of the leading end of the circular-arc portion 133Bb and to which a bringing pins 136 serving as a bringing member is secured at the leading end thereof.

Figure 4:
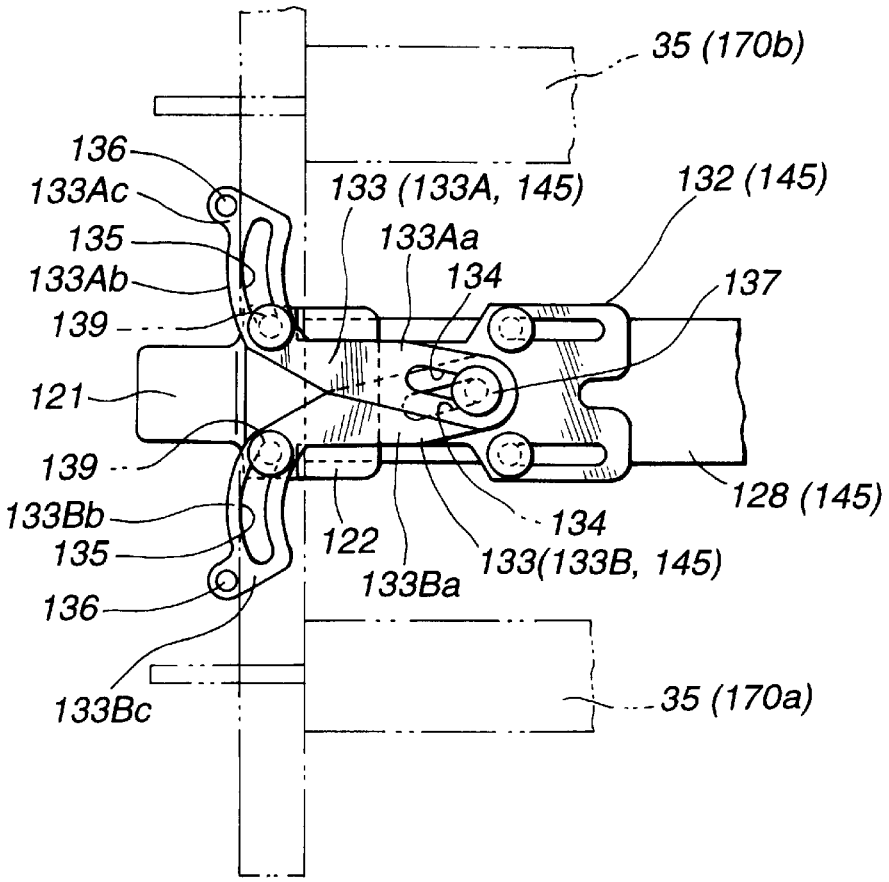
FIG. 4 is an enlarged plan view showing a portion including the leading end of the tape bringing means shown in FIG. 1 in a state in which a loop is held.

The tape bringing guide 133B of the pair of the tape bringing guides 133 shown in the left-hand portion in FIG. 3 is placed on the bringing-board moving plate 132. The base 133Aa of the tape bringing guide 133A shown in the right-hand portion in FIG. 3 is placed on the upper surface of the base 133Ba of the tape bringing guide 133B. The leading end of first fixing screw 137 is inserted into both of the elongated holes 134 formed in the bases 133Aa and 133Ba, and then screwed in a thread hole 138 formed at the substantially central portion of the bringing-board moving plate 132 in the lengthwise direction of the bringing-board moving plate 132, the thread hole 138 being structured into a through hole formed in the direction of the thickness. Moreover, the leading ends of two second fixing screws 139 are inserted into the circular-arc elongated holes 135 formed in the circular-arc portions 133Ab and 133Bb, respectively. Then, the second fixing screws 139 are screwed in two thread holes 140 formed adjacent to two leading end corners of the bringing-board moving plate 132 and structured into through holes formed in the direction of the thickness. Thus, the pair of the tape bringing guides 133 are joined to the upper surface of the bringing-board moving plate 132, as shown in FIG. 4. As shown in FIG. 3, a deformation-preventive member 141 comprising two washers through which the second fixing screws 139 can be inserted is disposed between the lower surface of the circular-arc portion 133Ab of the tape bringing guide 133A and the upper surface of the bringing-board moving plate 132. The deformation-preventive member 141 prevents deformation of the circular-arc portion 133Ab of the tape bringing guide 133A. The deformation is caused from a gap which is formed between the lower surface of the circular-arc portion 133Ab of the tape bringing guide 133A and the upper surface of the bringing-board moving plate 132 and which has a size which is the same as the thickness of the tape bringing guide 133B. Moreover, the deformation-preventive member 141 reliably secures the tape bringing guide 133A to the bringing-board moving plate 132. The bringing pins 136 of the pair of the tape bringing guides 133 are disposed to extend in parallel with each other on the outside of the two side surfaces of the tape receiving surface 121 of the tape support member 120, as shown in FIG. 4.

The bringing board 128, the bringing-board moving plate 132 and the pair of the tape bringing guides 133 constitute the tape brining member 142 according to this embodiment and capable of bringing the tape 12 placed on the tape receiving surface 121 to the positioning members 122.

Figure 5:
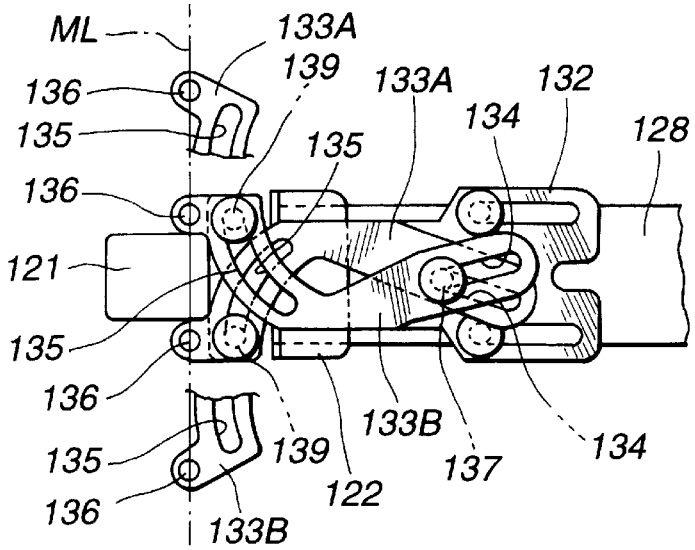
FIG. 5 is a diagram showing a state in which the distance between bringing pins provided for a pair of tape bringing guides of the tape bringing means shown in FIG. 1 is adjusted.

When the first fixing screw 137 and the second fixing screws 139 are loosened to move the pair of the tape bringing guides 133, the tape brining member 142 is able to adjust the distance between the bringing pins 136 extending in parallel with each other. Thus, the distance can be adjusted to correspond to the length of the belt loop 20 to be formed. At this time, the maximum and minimum distances between the bringing pins 136 can limited mainly by the lengths of the elongated holes 134 formed in the pair of the tape bringing guides 133. The locus of movement of each of the bringing pins 136 is limited by dint of the shape of each of the circular-arc elongated holes 135 formed in the pair of the tape bringing guides 133. The locus of movement is limited to movement on a straight line indicated by symbol ML shown in FIG. 5 parallels the lengthwise direction of the tape 12 which is supplied to the belt-loop forming position.

That is, the relationship between the positions of the bringing pins 136 and the position of the tape 12 supplied to the belt-loop forming position can easily be adjusted. Specifically, the distance of the bringing pins 136 of the pair of the tape bringing guides 133 can easily be adjusted to correspond to the length of the belt loop 20 without a necessity of changing the distance from the bringing pins 136 and the tape 12 supplied to the belt-loop forming position.

The distance between the bringing pins 136 of the pair of the tape bringing guides 133 can easily be adjusted to correspond to the length of the belt loop 20. Therefore, when the tape 12 supplied to the belt-loop forming position is brought to the positioning members 122 so as to be positioned along the positioning members 122, the bringing pins 136, which are brought into contact with the tape 12, can be brought into contact with the tape 12 at a position adjacent to two-way forks 172 provided for the leading ends of the pair of the bending shafts 170 to be described later. As a result, the tape 12 can reliably be set to the base portion of the two-way forks 172.

That is, the distances between the two-way forks 172 and the bringing pins 136 can be shortened. Therefore, deformation of the tape 12 positioned between the two-way forks 172 and the bringing pins 136 can reliably be prevented which is caused when the distance between the two-way forks 172 and the bringing pins 136 is too long. As a result, the relationship between the position of the tape 12 and the positions of the bases of the two-way forks 172 can always and constantly be maintained.

The tape bringing means 33 according to this embodiment is constituted by a tape bringing member, which comprises the tape receiving surface 121, the bringing pins 136 and the positioning members 122, and the tape holding member 130.

Figure 6:
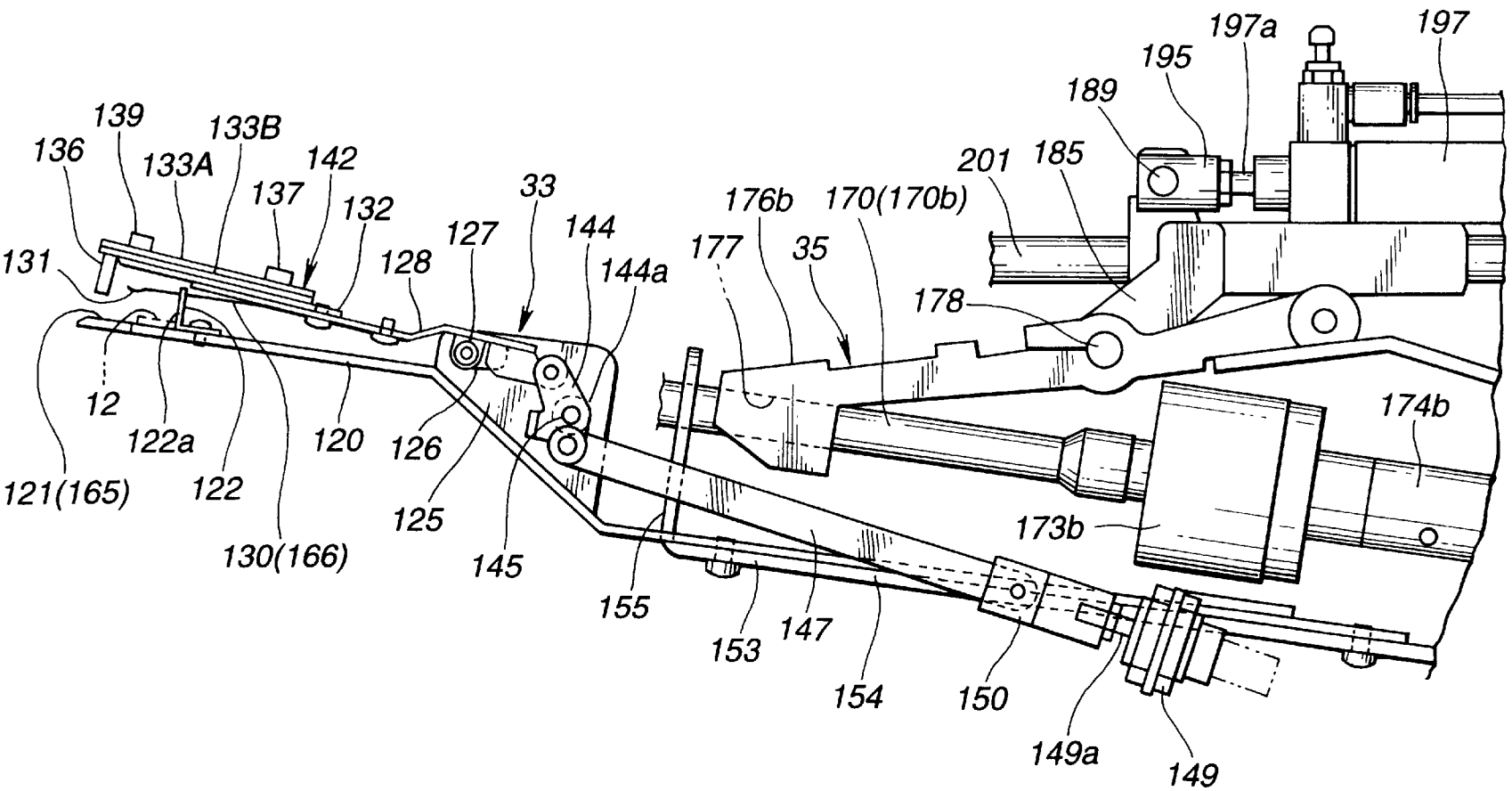
FIG. 6 is an enlarged front view showing a portion including the leading end of the tape bringing means shown in FIG. 1 in an opened state such that also a portion of a loop supply means is illustrated.

Referring back to FIG. 3, an end of the link plate 144 formed into a bell-crank-like shape and shown in an upper portion in FIG. 3 is rotatively connected to the base portion of the bringing board 128. A body 144*a* of the link plate 144 positioned at the substantially central portion of the link plate 144 in the lengthwise direction of the link plate 144 is rotatively supported by a link support shaft 145. The link support shaft 145 has two ends which are supported by a rear portion of the guide support portions 125 of the tape support member 120. The leading end of a connection plate 147 is rotatively connected to another end of the link plate 144 shown in a lower portion in FIG. 3. An output shaft 149*a* of a tape-bringing-operation driving means 149 comprising an air cylinder for rotating the link plate 144 and moving forwards/rearwards the bringing board 128 is connected to the rear end of the connection plate 147 through a connection member 150. When the output shaft 149*a* of the tape-bringing-operation driving means 149 is moved forwards/rearwards, the bringing pins 136 of the tape bringing member 142 are brought into contact with the positioning members 122 provided for the tape receiving surface 121 of the tape support member 120 and separated from the same. Moreover, the holding portion 131 of the tape holding member 130 is opened/closed such that the holding portion 131 is brought into contact with the tape 12 or separated from the same. Thus, an opened state can be selected which is shown in FIG. 6 in which the bringing pins 136 are positioned at upper positions in front of the tape receiving surface 121 so that placement of the tape 12 on the tape receiving surface 121 is permitted. As an alternative to this, a holding state shown in FIG. 7 can be selected. The holding state is a state in which the bringing pins 136 bring one side of the tape 12 placed on the tape receiving surface 121 into contact with the contact surface 122*a* of the positioning members 122 so as to align and position the tape 12. Moreover, the holding portion 131 of the tape holding member 130 presses the upper surface of the tape 12 to hold the tape 12. The tape-bringing-operation driving means 149 can be moved by a tape-bringing-operation driving electromagnetic valve 151 (see FIG. 15) connected to the control means 210 (see FIG. 15) to be described later. In accordance with a control command issued from the control means 210 to the tape-bringing-operation driving electromagnetic valve 151, the tape-bringing-operation driving means 149 is moved forwards/rearwards for a predetermined stroke at predetermined timing. The tape-bringing-operation driving means 149 is joined to the joining portion 124 of the tape support member 120 through a sub-stay 129.

The tape bringing member 142 will furthermore specifically be described. In the opened state shown in FIG. 6, the output shaft 149*a* of the tape-bringing-operation driving means 149 is positioned at a rear end after it has been moved rearwards. At this time, the link plate 144 has pivoted about the link support shaft 145. The bringing board 128 has clockwise pivoted about the bringing-board support shaft 127 because of the counterclockwise rotation of the link plate 144. Moreover, the bringing-board support shaft 127 supported by the guide support portions 125 of the tape support member 120 has been positioned at a forward position which is the frontmost position (in the left-hand position in FIG. 6) in the elongated holes 126. The leading ends of the bringing pins 136 (the lower ends in FIG. 6) are positioned maximally away from the positioning members 122 in an upper front direction. Also the holding portion 131 of the tape holding member 130 is positioned maximally away from the tape receiving surface 121 in an upper front direction.

Figure 7:
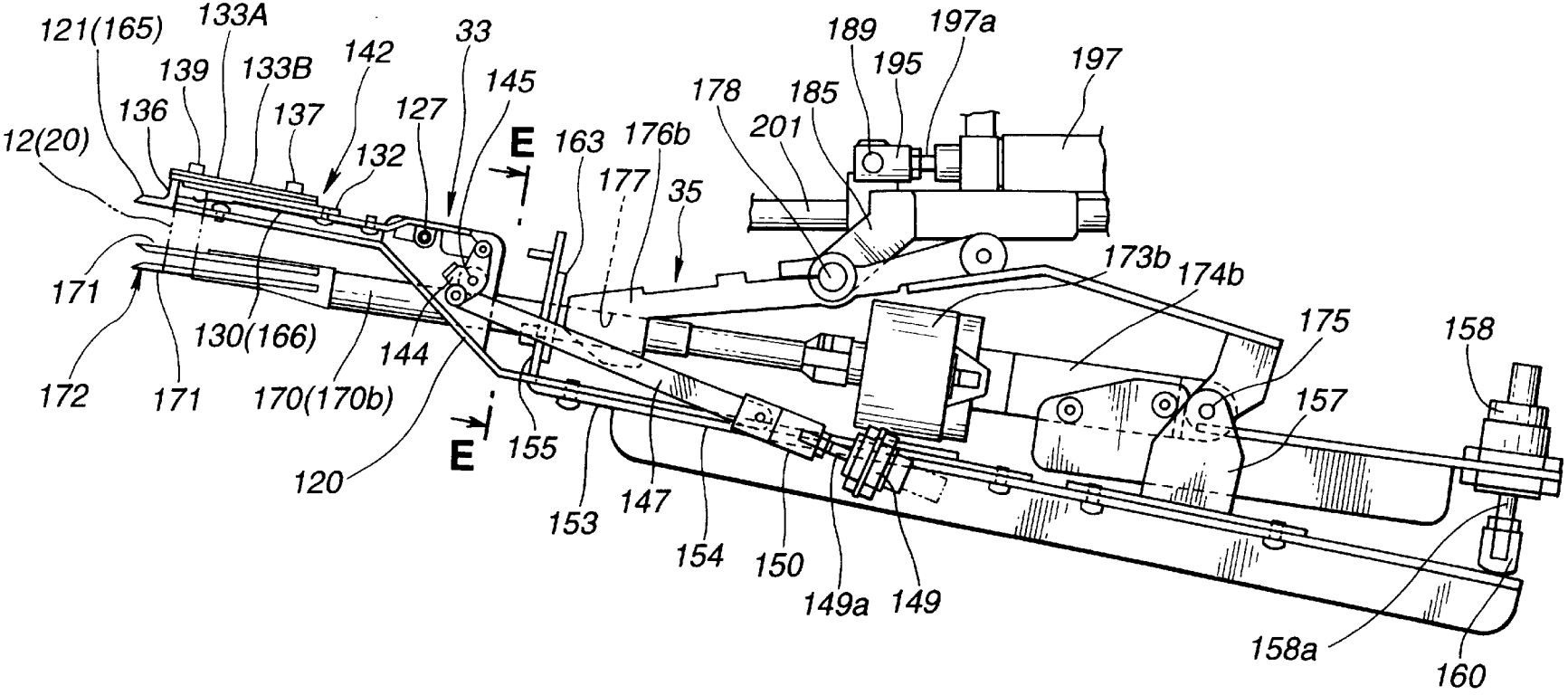
FIG. 7 is an enlarged front view showing a portion including the leading end of the tape bringing means shown in FIG. 1 in a holding state such that also a portion of the loop supply means is illustrated.

In the holding state shown in FIG. 7, the output shaft 149*a* of the tape-bringing-operation driving means 149 is positioned at a front end after it has been moved forwards. The link plate 144 has clockwise pivoted about the link support shaft 145. The bringing board 128 has pivoted about the bringing-board support shaft 127 because of the clockwise rotation of the link plate 144. Moreover, the bringing-board support shaft 127 for causing the guide support portions 125 of the tape support member 120 to support the bringing board 128 is positioned at the rear end position which is the rearmost position (in a right-hand position in FIG. 7) in the elongated holes 126. The bringing pins 136 has been moved maximally closer to the positioning members 122. The leading ends (the lower ends in FIG. 6) of the bringing pins 136 downwards project over the tape receiving surface 121 on the two side surfaces of the tape receiving surface 121. Also the holding portion 131 of the tape holding member 130 has moved maximally closer to the positioning members 122 so as to be brought into contact with the upper surface of the tape 12 positioned on the tape receiving surface 121. Thus, the upper surface of the tape 12 is pressed.

Figure 8:
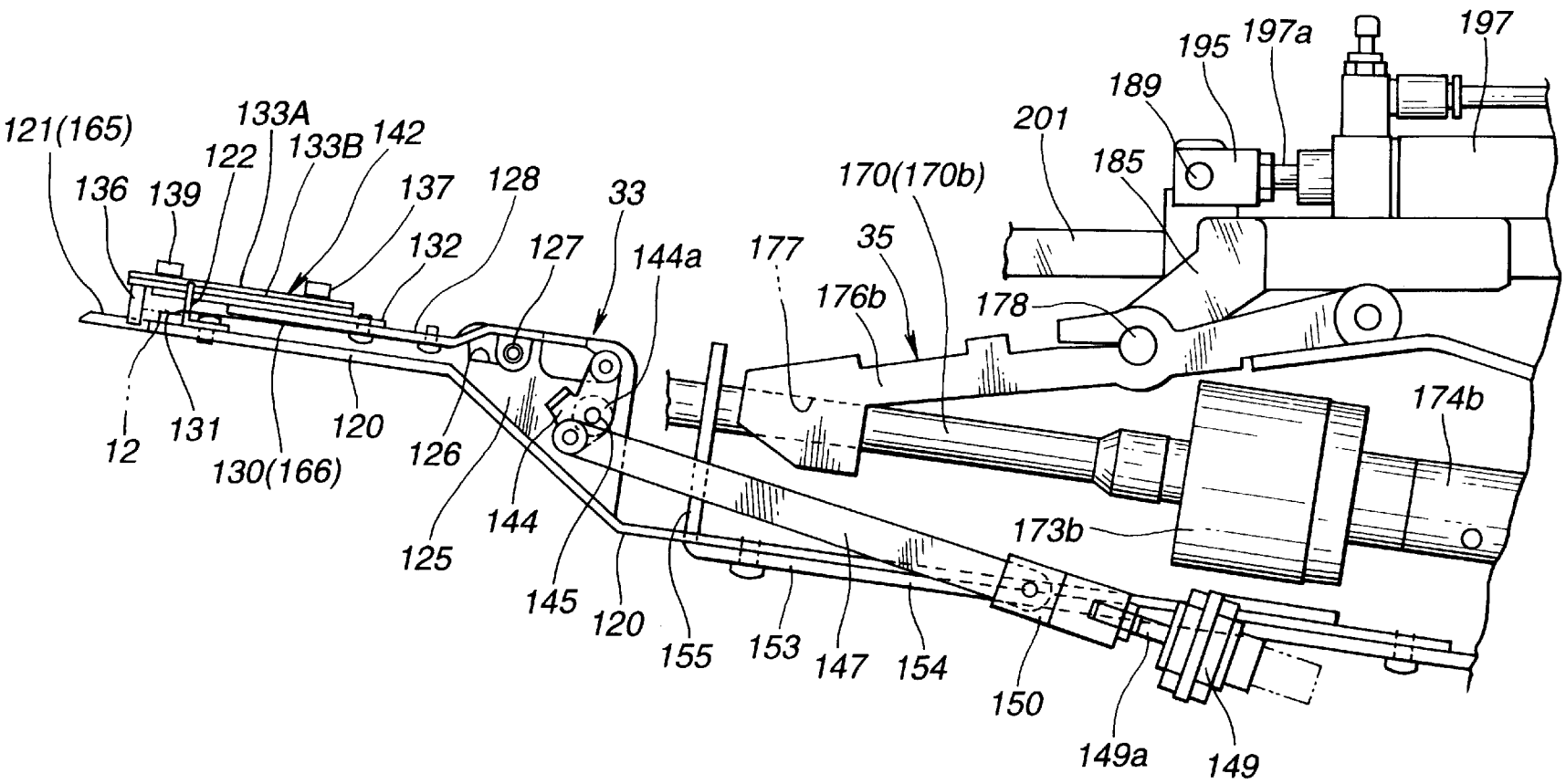
FIG. 8 is an enlarged front view showing an operation of the tape bringing means shown in FIG. 1 for forming a fullness such that also a portion of the loop supply means is illustrated.

Referring back to FIG. 3, the joining portion 124 of the tape support member 120 is joined to an L-like tape-bringing base plate 153. The tape-bringing base plate 153 incorporates a substantially horizontal base 154 and a vertical portion 155 upwards bent substantially perpendicularly on the right side (in FIG. 3) of the front end of the base 154. The tape support member 120 has the joining portion 124 which is joined to the upper surface of the base 154 of the tape-bringing base plate 153. Moreover, a tape-bringing support bracket 157 is rotatively supported at the central portion of the connection support shaft 175 of the loop supply means 35 to be described later. Moreover, the leading end of a contact member 160 joined to the leading end of an output shaft 158*a* of a fullness-forming-operation driving means 158 has been brought into contact with the upper surface of the rear end of the base 154 of the tape-bringing base plate 153. The fullness-forming-operation driving means 158 is operated by a fullness-forming-operation driving electromagnetic valve 162 (see FIG. 15) connected to the control means 210 (see FIG. 15) to be described later. The fullness-forming-operation driving means 158 is moved forwards/rearwards at a predetermined timing for a predetermined stroke in accordance with a control command issued from the control means 210 to the fullness-forming-operation driving electromagnetic valve 162. When the output shaft 158*a* of the fullness-forming-operation driving means 158 is moved forwards/rearwards, the tape-bringing base plate 153 pivots about the connection support shaft 175. As a result, as shown in FIG. 8, the tape receiving surface 121 of the tape support member 120 upwards moves the central portion of the belt loop 20 so that a fullness is formed. The "fullness" is a state of the belt loop formed in a loose state. That is, the tape receiving surface 121 of the tape support member 120 has a function of a fullness forming means 165 (a belt-loop tension releasing means) which is brought into contact with the tape 12 or the belt loop 20 between the pair of the bending shafts 170 so as to form the fullness. The fullness-forming-operation driving means 158 is, through an appropriate joining member 159, joined to the side surface of the connection base 174*a* of the loop supply means 35 to be described later.

Moreover, the tape holding member 130 has a function realized in cooperation with the tape receiving surface 121 of the tape support member 120 serving as the fullness forming means 165 and serving as a tape holding means 166 for holding the tape 12 or the belt loop 20.

Figure 9:
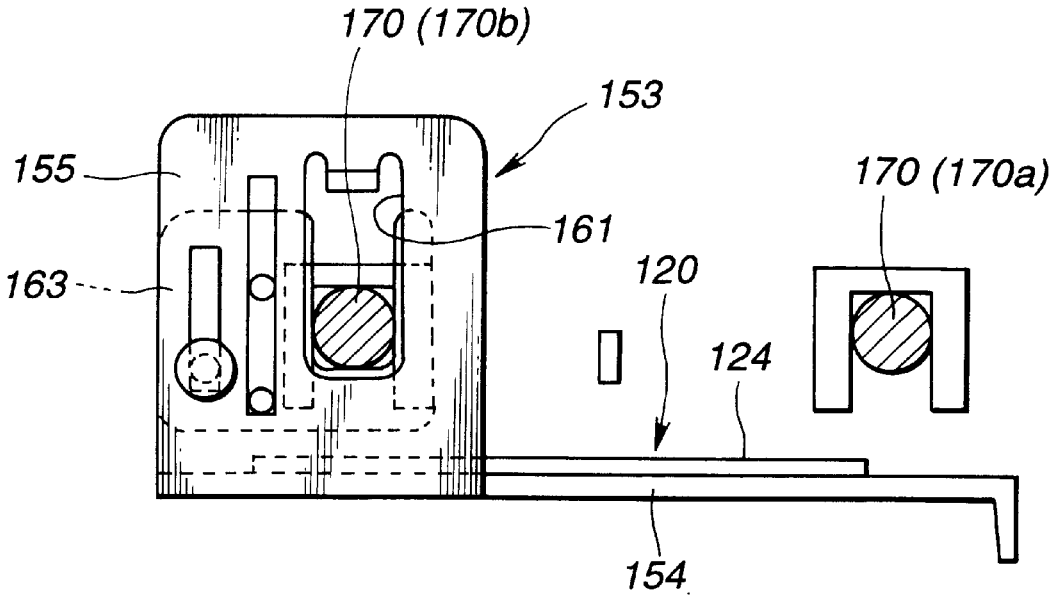
FIG. 9 shows the lower portion of an outer shaft of a rear bending shaft positioned adjacent to a lower end of a through hole of an adjustment plate.
Figure 10:
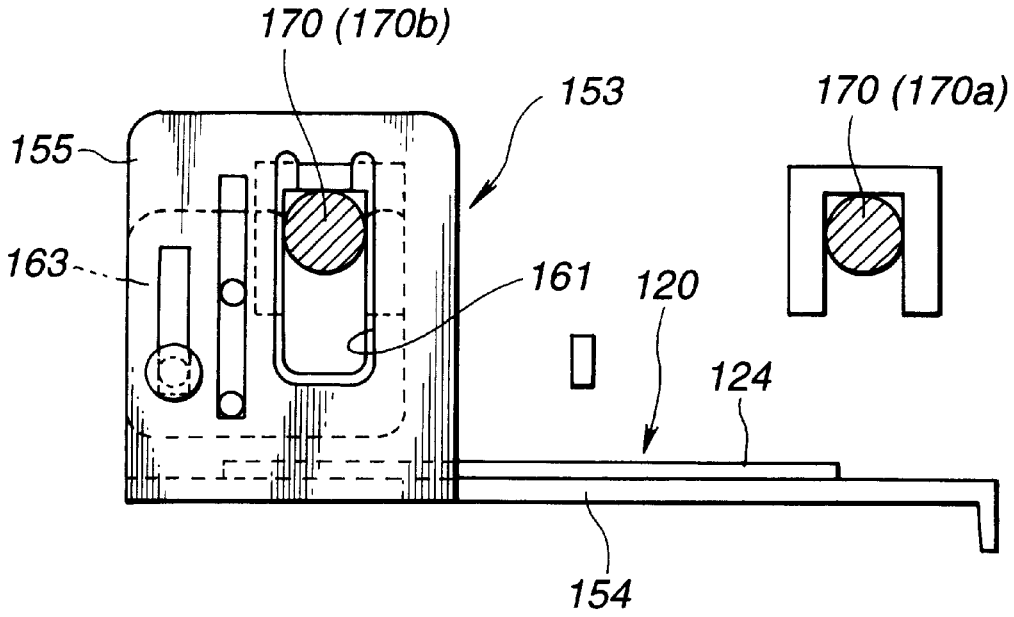
FIG. 10 is a partially-cut cross sectional view taken along line E—E shown in FIG. 7 and showing opened and holding states of the tape bring means before the leading end of the tape bringing means shown in FIG. 1 is moved upwards.

A through hole 161 formed in the direction of the thickness and permitting a rear bending shaft 170*b* of the loop supply means 35 to be described later to be inserted such that the rear bending shaft 170*b* is able to move vertically is provided for the vertical portion 155 of the tape-bringing base plate 153. Moreover, an adjustment plate 163 for adjusting the vertical length of the tape support member 120 is joined to the vertical portion 155 of the tape-bringing base plate 153. When the fullness is formed, the adjustment plate 163 is, as shown in FIGS. 9 and 10, suspended downwards from the vertical portion 155 of the tape-bringing base plate 153 so as to permit vertical movement of the tape-bringing base plate 153 along the rear bending shaft 170*b* of the loop supply means 35 to be described later. In a fullness forming state which is shown in FIG. 8 and in which the leading end of the tape support member 120 having the function to serve as the fullness forming means 165 of the tape bringing means 33 has been moved upwards, the lower portion of the outer surface of the rear bending shaft 170*b* is positioned adjacent to the lower end of the through hole 161 of the adjustment plate 163, as shown in FIG. 9. In the opened and holding state of the tape bringing means 33 which is realized before the leading end of the tape bringing means 33 is moved upwards, the upper portion of the outer surface of the rear bending shaft 170*b* is in contact with the upper end of the through hole 161 of the adjustment plate 163, as shown in FIG. 10.

Figure 11:
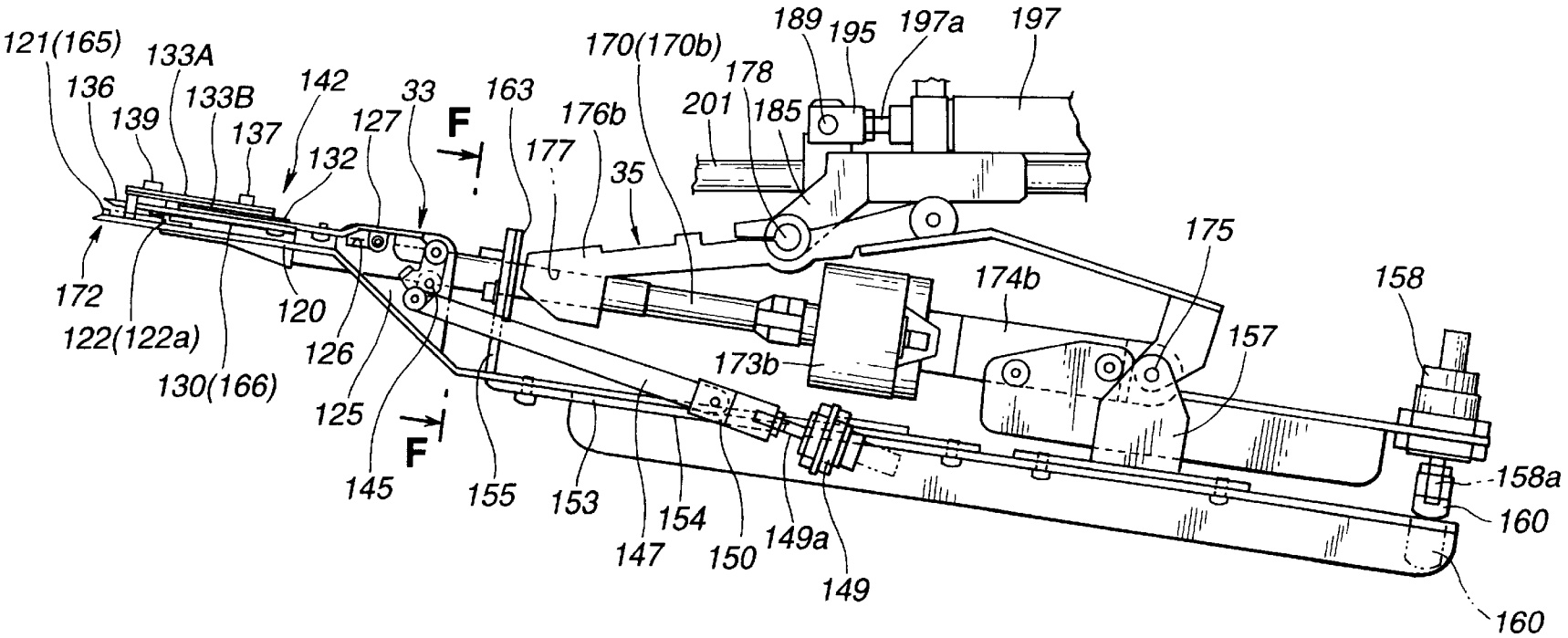
FIG. 11 is an enlarged front view showing a usual state in which no fullness is provided for the belt loop by the tape bringing means shown in FIG. 1 such that also a portion of the loop supply means is illustrated.
Figure 12:
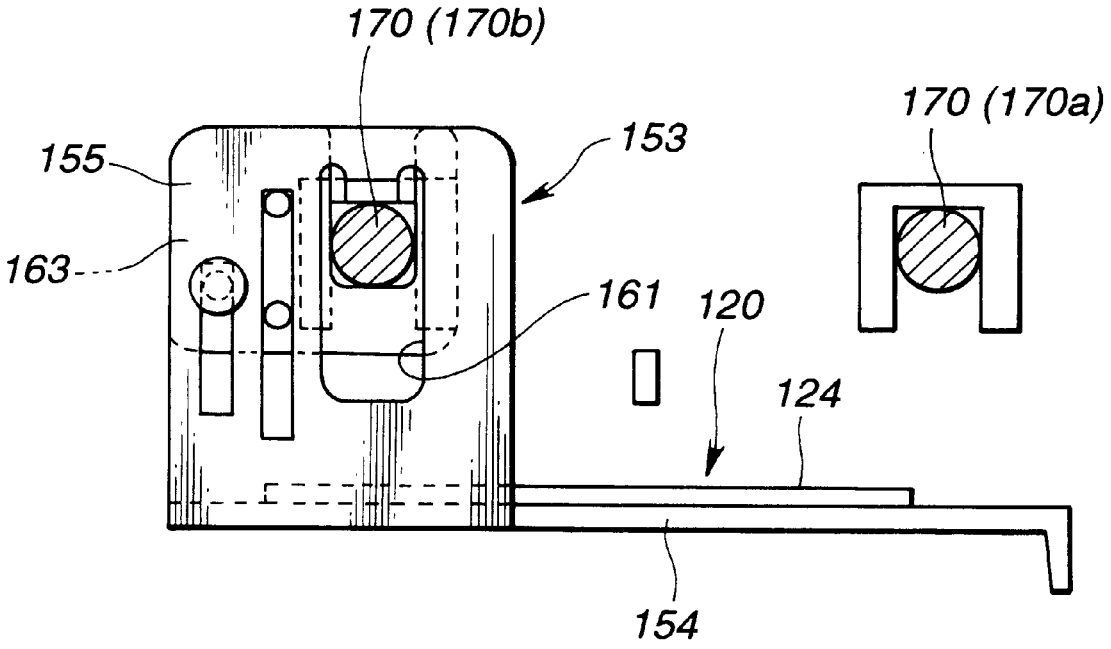
FIG. 12 is a partially-cut cross sectional view taken along line F—F shown in FIG. 1.

When the fullness of the belt loop 20 is not formed, the adjustment plate 163 is moved to a position above the vertical portion 155 of the tape-bringing base plate 153 so as to be joined, as shown in FIGS. 11 and 12. Thus, the adjustment plate 163 can be secured in such a manner that the vertical movement of the tape-bringing base plate 153 along the rear bending shaft 170*b* of the loop supply means 35 to be described later is inhibited. As a result, undesirable vertical movement of the tape bringing means 33 can be prevented.

The loop supply means 35 will now be described further in detail with reference to FIGS. 1, 8, 9, 13 and 14.

Figure 13:
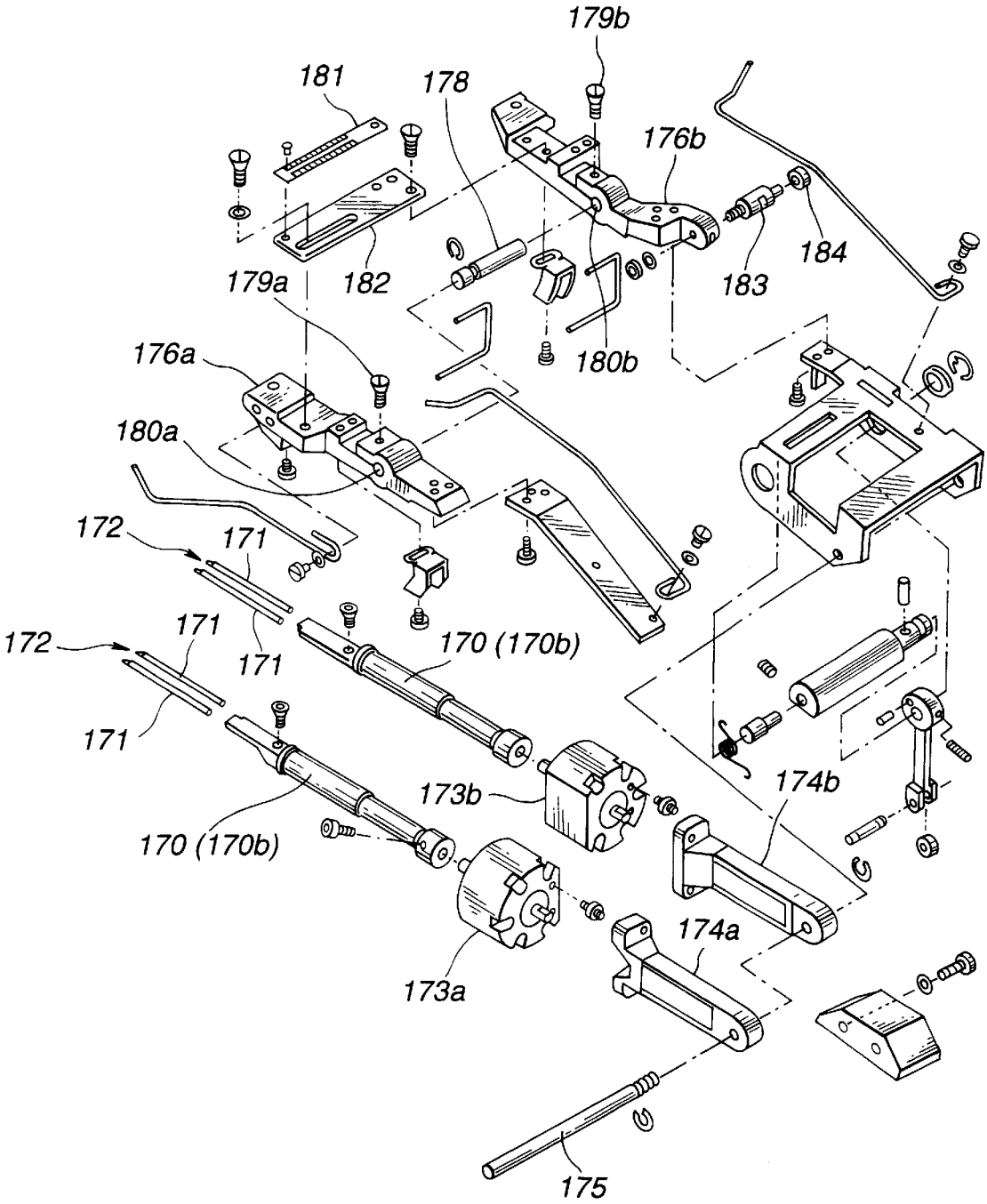
FIG. 13 is an exploded perspective view showing a portion including the bending shaft of the loop supply means shown in FIG. 1.

The loop supply means 35 folds the two ends of the belt loop 20 formed at the belt-loop forming position toward the central portion of the belt loop 20 so as to supply the belt loop 20 to the sewing position of the machine. As shown in FIG. 13, the loop supply means 35 incorporates a pair of front and rear bending shafts 170. One of the bending shafts 170 shown in the left-hand portion in FIG. 13 is a front bending shaft 170*a* for folding the base portion of the belt loop 20. On the other hand, the other one of the bending shafts 170 is a rear bending shaft 170*b* for folding the leading end portion of the belt loop 20. Two pins 171 disposed apart from each other for an appropriate distance and parallel each other are secured to the leading ends of the bending shafts 170. Thus, the forks 172 which can be sidewards inserted into the tape 12 or the belt loop 20 are formed. A portion of the rear bending shaft 170*b* which is more forwards than the central portion of the rear bending shaft 170*b* is inserted into the through hole 161 formed in the vertical portion 155 of the tape-bringing base plate 153 of the tape bringing means 33 (see FIG. 10).

Bending-operation driving means 173*a* and 173*b* comprising rotary air cylinders which are capable of rotating the bending shafts 170 are joined to the base portions of the bending shafts 170. The bending-operation driving means 173*a* and 173*b* can solely be operated by bending-operation driving electromagnetic valves 190*a* and 190*b* (state FIG. 15) connected to the control means 210 (see FIG. 15) to be described later. In accordance with a control command issued from the control means 210 to the bending-operation driving electromagnetic valves 190*a* and 190*b*, the bending-operation driving means 173*a* and 173*b* are able to rotate the bending shafts 170 at predetermined timing.

When the bending-operation driving electromagnetic valve 190*a* is operated, the bending-operation driving means 173*a* rotates the front bending shaft 170*a*. When the bending-operation driving electromagnetic valve 190*b* is operated, the bending-operation driving means 173*b* rotates the rear bending shaft 170*b*. As described above, the front bending shaft 170*a* and the rear bending shaft 170*b* can be operated simultaneously or at different timing.

The timing at which the front bending shaft 170*a* and the rear bending shaft 170*b* are operated may be determined to correspond to the operating order for forming the fullness of the belt loop 20 or the attempted design concept.

The connection bases 174*a* and 174*b* are joined to the rear ends of the bending-operation driving means 173*a* and 173*b*. An end of the connection support shaft 175 shown in the right-hand portion in FIG. 13 is joined to the rear end of the connection base 174*b*. Another end of the connection support shaft 175 shown in a left-hand portion in FIG. 13 is inserted into the rear end of the other connection base 174*a*. The connection base 174*a* is able to move along the outer surface of the connection support shaft 175 in the axial direction of the connection support shaft 175. The tape-bringing support bracket 157 is rotatively inserted into the central portion of the connection support shaft 175 so as to be supported by the connection support shaft 175 (see FIG. 3).

The central portions of the bending shafts 170 are inserted into support holes 177 (see FIGS. 6 to 9) formed at the leading end portions of the bent shaft support members 176*a* and 176*b* called a seesaw guide levers so as to be supported by the support holes 177. Clamping holes 180*a* and 180*b* having holdable slits are formed in the central portions of the bent shaft support members 176*a* and 176*b* in the lengthwise directions of the bent shaft support members 176*a* and 176*b*.

Figure 14:
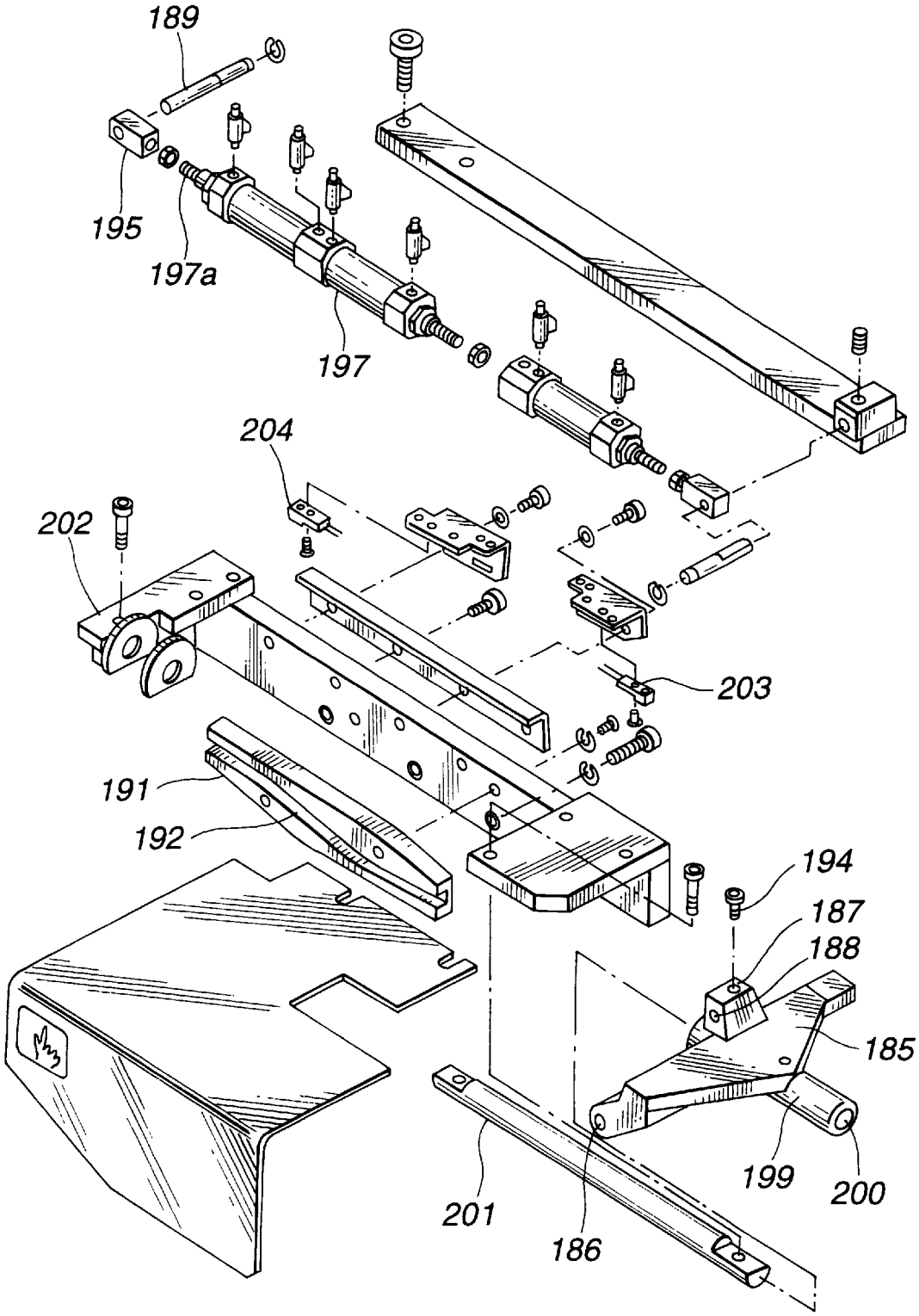
FIG. 14 is an exploded perspective view showing a portion including a bent shaft driving means of the loop supply means shown in FIG. 1.

Portions adjacent to the two ends of the main connection shaft 178 for connecting the bent shaft support members 176*a* and 176*b* in parallel with each other are inserted into the clamping holes 180*a* and 180*b*. The two ends of the main connection shaft 178 are inserted into main-connection-shaft support holes 186 (only one is shown in FIG. 14) formed at the two corners at the leading end of the movable base 185 (see FIG. 14) formed into a T-like shape in a plan view. When the clamping bolt 179*a* and 179*b* are screwed in thread holes (not shown), the bent shaft support members 176*a* and 176*b* are secured to the main connection shaft 178.

That is, either of the clamping bolt 179*a* and 179*b*, for example, the clamping bolt 179*a* is loosened so that the distance between the bent shaft support members 176*a* and 176*b* is adjusted. As a result, the distance between the bending shafts 170 can be adjusted to correspond to the length of the belt loop 20.

Although the adjustment of the distance between the bending shafts 170 can be performed by loosening the two clamping bolt 179*a* and 179*b*, it is preferable that a method is employed in which the position of the front bending shaft 170*a* positioned adjacent to the base portion of the belt loop 20 is always fixed and the position of the rear bending shaft 170*b* positioned adjacent to the leading end of the belt loop 20 is adjusted. In this case, a predetermined distance between the tape cutting means 34 and the front bending shaft 170*a* can always be maintained. Moreover, labor required to adjust the distance between the front bending shaft 170*a* and the rear bending shaft 170*b* can be reduced.

A display-plate joining member 182 having an upper surface to which a distance display plate 181 for displaying the distance between the pair of the bending shafts 170 is joined is disposed on the upper surface of the leading end portions of the bent shaft support members 176*a* and 176*b*. The display-plate joining member 182 is disposed such that the leading ends of the bent shaft support members 176*a* and bent shaft support member 176*b* are connected to each other. The base portion of a roller support shaft 183 is joined to the side surface of the rear portion of the bent shaft support member 176*b* positioned adjacent to the tape 12 or the belt loop 20. The base portion is disposed perpendicular to the lengthwise direction of the bent shaft support member 176*b*. A roller 184 is rotatively joined to the leading end of the roller support shaft 183. The roller 184 is engaged to a cam groove 192 formed on the side surface of a movement locus limiting member 191 stood erect on a base plate (not shown) shown in FIG. 14, the cam groove 192 having a predetermined shape.

As shown in FIG. 14, a connection-pin joining portion 187 projects over the upper surface of the central portion of the leading end of the movable base 185. A connection-pin securing hole 188 is formed in the connection-pin joining portion 187. An end of a connection pin 189 is secured to the connection-pin securing hole 188 by a fixing screw 194. Another end of the connection pin 189 rotatively supports a cylinder mounting bracket 195. An output shaft 197*a* of a bent shaft driving means 197 is joined to the cylinder mounting bracket 195. The bent shaft driving means 197 comprises a three-stage air cylinder for permitting the pair of the bending shafts 170 to be moved to at least three positions consisting of the retraction position, a loop folding position and the sewing position shown in FIG. 1. The bent shaft driving means 197 can be operated by a bent shaft driving electromagnetic valve 198 (see FIG. 15) connected to the control means 210 (see FIG. 15) to be described later. Moreover, the bent shaft driving means 197 is operated at predetermined timing in accordance with a control command issued from the control means 210 to the bent shaft driving electromagnetic valve 198. When the pair of the bending shafts 170 is moved forwards/rearwards among the three positions consisting of the retraction position, the loop folding position and the sewing position, the vertical movement locus of the bent shaft driving means 197 is controlled such that the movement is performed along the shape of the cam groove 192. The tape bringing support bracket 157 of the tape bringing means 33 is supported by the connection support shaft 175 of the loop supply means 35 (see FIGS. 8 and 9). Therefore, also the tape bringing means 33 is able to move forwards/rearwards between the retraction position and the sewing position shown in FIG. 1 in synchronization with the forward/rearward movement of the pair of the bending shafts 170.

That is, the structure is constituted such that the bent shaft driving means 197 causes the pair of the bending shafts 170 and the tape bringing means 33 to integrally be moved forwards/rearwards. That is, the tape bringing means 33 is supported by the loop supply means 35 so as to be operated in synchronization with the loop supply means 35.

A rod joining portion 199 is disposed on the lower surface of the movable base 185, the rod joining portion 199 having a guide hole 200. A guide rod 201 having front and rear ends which are supported by a support member 202 stood erect on the base plate (not shown) is inserted into the guide hole 200. That is, the fore-and-aft movement locus of the movable base 185 along the guide rod 201 is controlled. As a result, the forward/rearward movement locus which is realized when the pair of the bending shafts 170 are moved forwards/rearwards between the retraction position and the sewing position shown in FIG. 1 is controlled.

A retraction-position sensor 203 and a folding-position sensor 204 arranged to detect the retraction position of the pair of the bending shafts 170 and the loop folding position and comprising proximity switches are joined to the support member 202. The retraction-position sensor 203 and the folding-position sensor 204 are electrically connected to the control means 210 (see FIG. 15) to be described later. When the right corner of the movable base 185 has approached, the position of the movable base 185, that is, the positions of the bending shafts 170 and the tape bringing means 33 are detected. Then, detection signals are transmitted to the control means 210.

Note that the structure according to this embodiment incorporates the following elements: a sewing-position sensor 205 for detecting the positions of the bending shafts 170 of the loop supply means 35 after the belt loop 20 has been moved to the sewing position; a temporary-stop-position sensor 206 (see FIG. 15) for detecting the positions of the bending shafts 170 of the loop supply means 35 after the belt loop 20 has been brought to a temporary stop position to be described later; a loop supply switch 207 (see FIG. 15) for supplying the belt loop 20 to the sewing position and starting a sewing operation; and a body-part detection sensor 208 (see FIG. 15) serving as a body-part detection means for detecting whether or not the sewn product S has been set on the needle plate 6 of the belt-loop sewing machine 2.

An example of the control means 210 will now be described with reference to FIG. 15.

Figure 15:
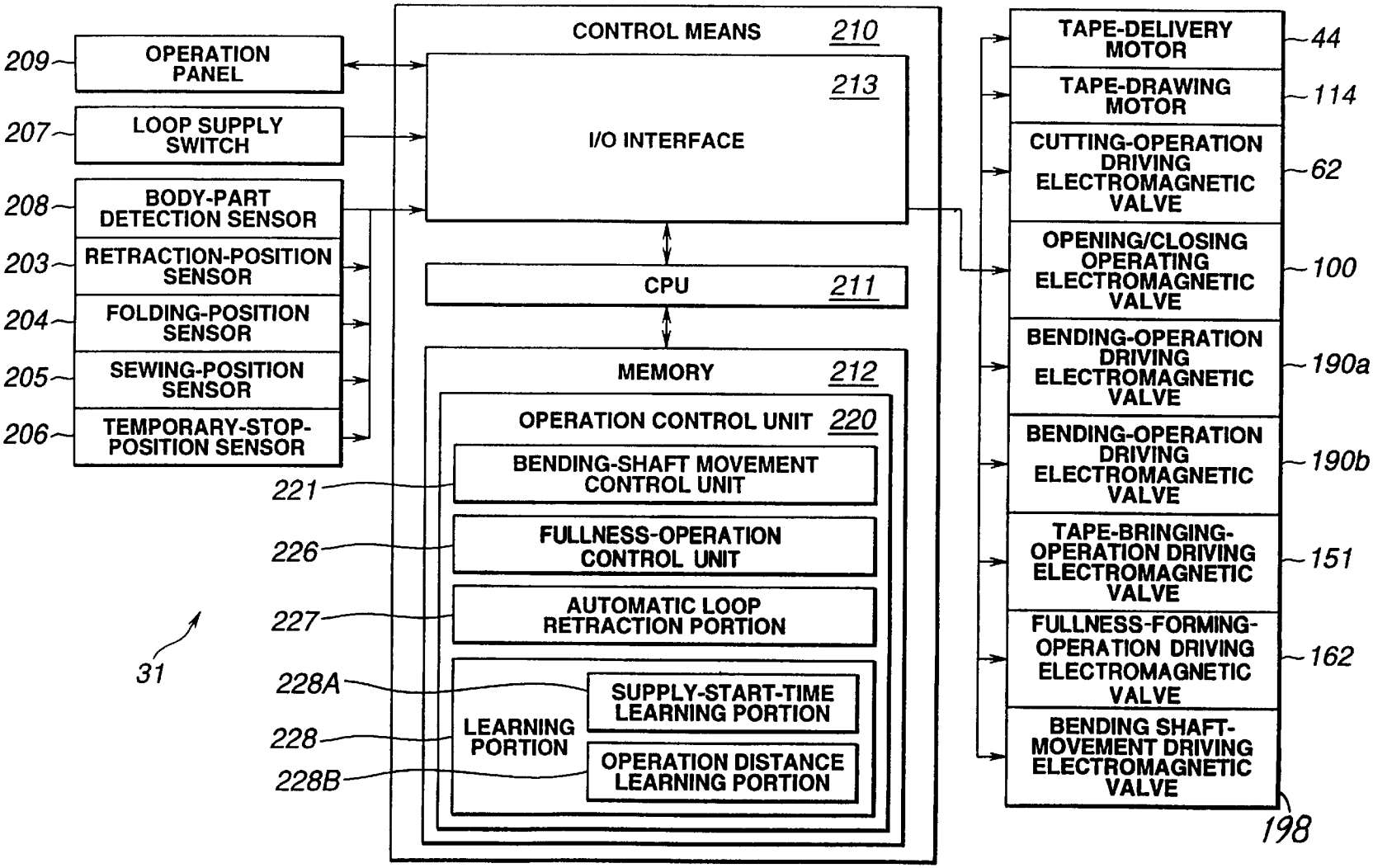
FIG. 15 is a block diagram showing a control means of the belt-loop supply apparatus shown in FIG. 1.

As shown in FIG. 15, the control means 210 according to this embodiment comprises a CPU 211, a memory 212 consisting of ROMs and a RAM each having an appropriate capacity; and an I/O interface 213 for establishing the connections between the belt-loop supply apparatus 31 and a variety of units. The following elements are connected to the I/O interface 213: the tape delivery motor 44, the cutting-operation driving electromagnetic valve 62, the opening/closing operating electromagnetic valve 100, the tape drawing motor 114, the tape-bringing-operation driving electromagnetic valve 151, the fullness-forming-operation driving electromagnetic valve 162, the bending-operation driving electromagnetic valves 190*a* and 190*b*, the bent shaft driving electromagnetic valve 198, the retraction-position sensor 203, the folding-position sensor 204, the sewing-position sensor 205, the temporary-stop-position sensor 206, the loop supply switch 207, the body-part detection sensor 208, the belt loop 20, a variety of switches including a sewing operation start switch (not shown) for controlling the sewing operation of the belt-loop sewing machine 2 and a machine motor. An operation panel 209 is provided with a variety of setting switches (not shown) for setting the length of the belt loop and whether or not the fullness is formed, a power supply switch, a start switch and a display unit which is capable of displaying an error and a state of the operation.

The memory 212 incorporates an operation control unit 220 for controlling the elements of the belt-loop supply apparatus 31. The operation control unit 220 at least incorporates a bent shaft control unit 221, a fullness-operation control unit 226, an automatic loop retraction portion 227 and a learning portion 228.

In the bent shaft control unit 221, the following programs are stored: a program forwards/rearwards controlling the speed at which the bending shafts 170 (170*a* and 170*b*) are moved by the bent shaft driving means 197 when the belt loop 20 is supplied to the sewing position; and a program for controlling the position to which the bending shafts 170 (170*a* and 170*b*) is moved by the bent shaft driving means 197 when the sewing position is changed.

In the automatic loop retraction portion 227, a program has been stored which controls the operation of the loop supply means 35 such that the belt loop 20 is moved to the belt-loop forming position if the sewing position is not started after predetermined standby time has elapsed when the belt loop 20 has been moved to the sewing position. The time for which the belt loop 20 is made to be on standby at the sewing position may be determined to meet a requirement, such as a design concept.

A learning program for driving the operation of the loop supply means 35 to be adaptable to the operation of an operator has been stored in the learning portion 228. The learning portion 228 according to this embodiment incorporates a supply-start-time learning portion 228A and an operation-distance learning portion 228B.

In the supply-start-time learning portion 228A, a program has been stored which learns time taken from a moment at which the body-part detection sensor 208 serving as the body-part detection means detects a fact that the sewn product S, such as jeans, has been set for the purpose of sewing a first belt loop 20 to the sewn product S to a moment at which the operator operates the loop supply switch 207 to interrupt the supply of the belt loop 20 to the sewing position.

In the operation control unit 220, the following programs and data have been stored: a program for operating the cutting-operation driving electromagnetic valve 62 and the opening/closing operating electromagnetic valve 100 at predetermined timing; a program for controlling the amounts of rotations of the tape delivery motor 44 and the tape drawing motor 114 in accordance with the length of the belt loop 20 set by operating the operation panel 209 so as to supply the tape 12 by a set length; a program for performing an initializing operation after power supply has been started; a variety of data and a programs required to perform the sewing operation.

Since the structure of the belt-loop sewing machine 2 which incorporates the belt-loop supply apparatus 31 according to this embodiment is similar to that of the conventional machine, the structure is omitted from detailed description.

Figure 16:
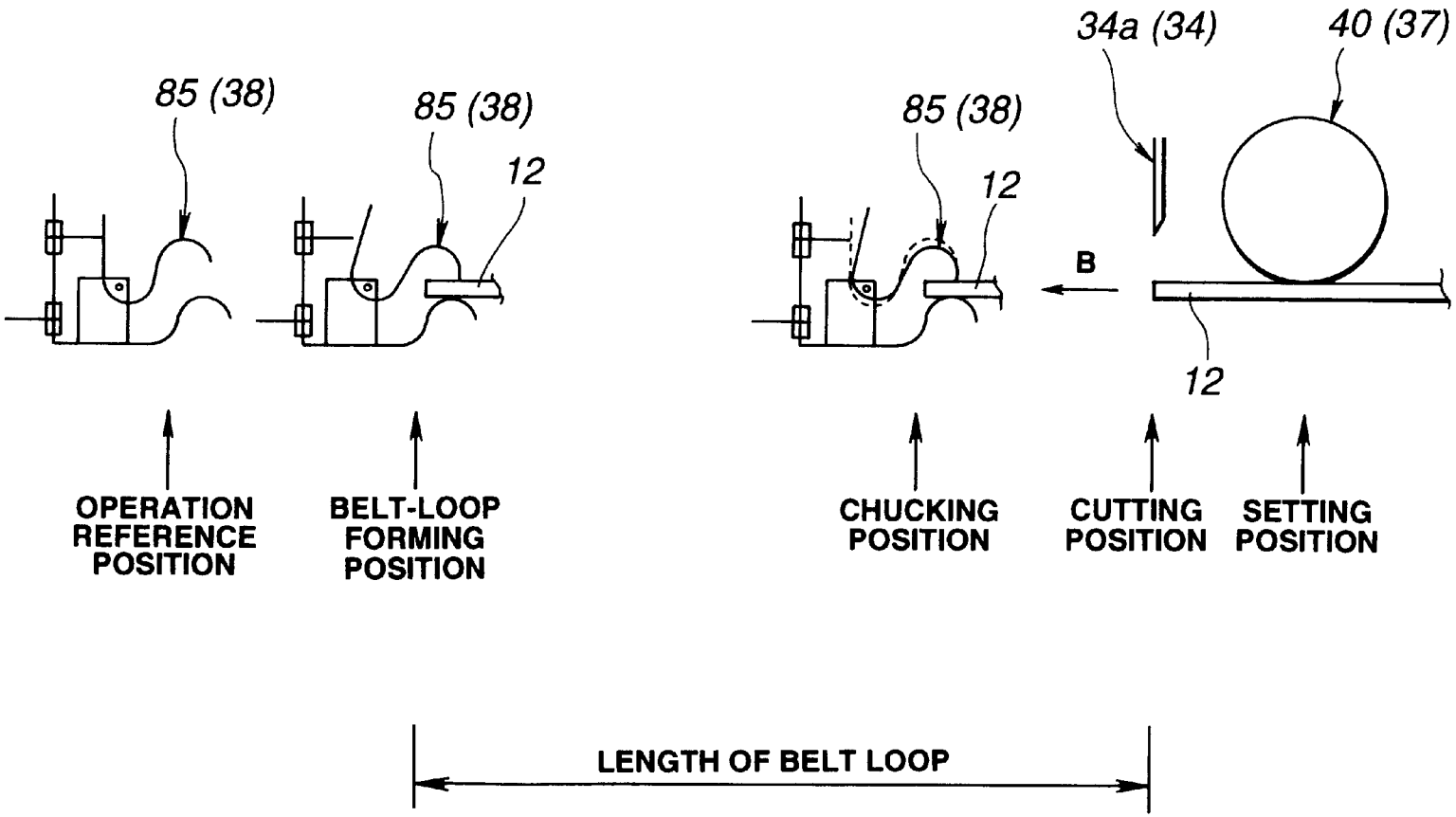
FIG. 16 is a schematic view showing a state in which a belt-loop supply means of the belt-loop supply apparatus according to a first embodiment of the present invention supplies a tape.
Figure 17:
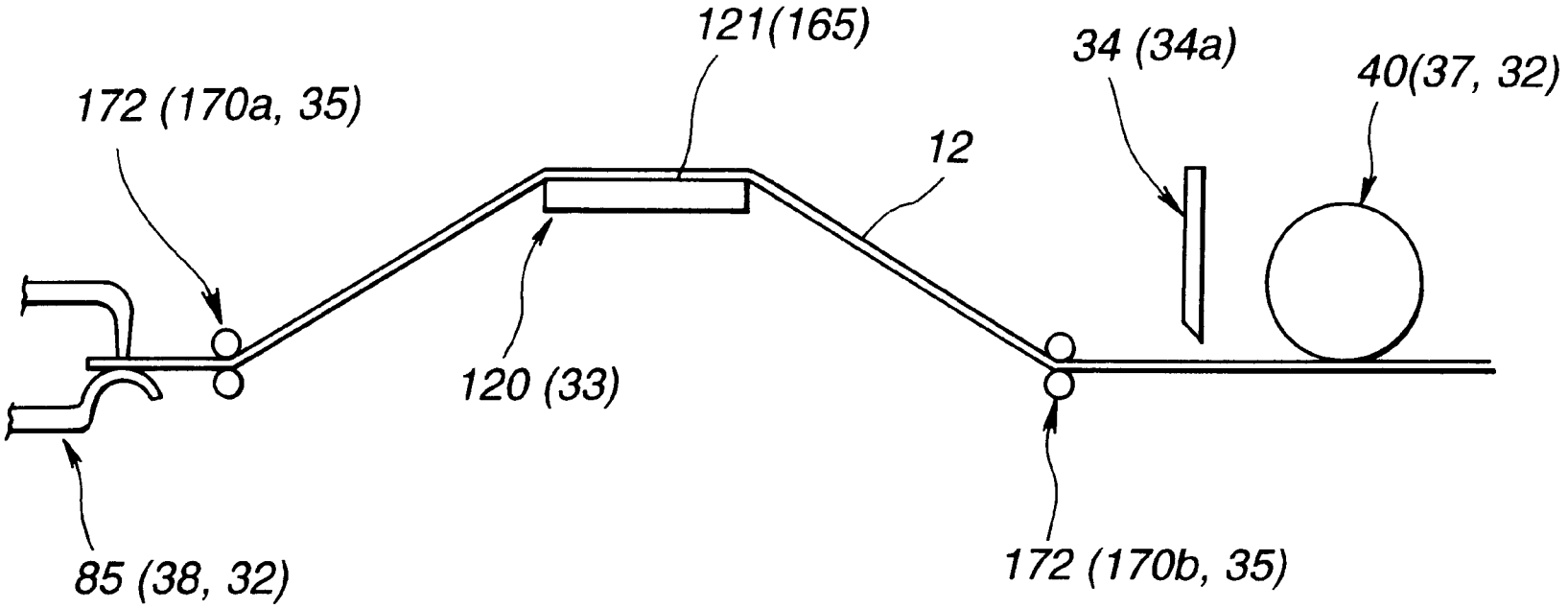
FIG. 17 is a schematic view showing a state in which a fullness is formed by the belt-loop supply apparatus according to the first embodiment of the present invention when the state is viewed from the side surface of the belt loop.

Then, the operation of this embodiment structured as described above will now be described with reference to FIG. 16 and FIG. 17.

Prior to performing the operation of the belt-loop supply apparatus 31 according to this embodiment, the elements of the belt-loop supply apparatus 31 are adjusted to correspond to the length of the belt loop 20.

That is, the delivery-frame holder 49 is moved in the direction of movement of the tape 12 for forming a required belt loop 20. Then, the tape delivery means 37 and the tape cutting means 34 are positioned.

The distance between the front bending shaft 170*a* and the rear bending shaft 170*b* is adjusted to form the required belt loop 20.

The distance between the bringing pins 136 of the tape bringing means 33 is adjusted by the elongated holes 134 to correspond to the distance between the front bending shaft 170*a* and the rear bending shaft 170*b*.

As shown in FIGS. 11 and 12, the adjustment plate 163 is moved to a position above the vertical portion 155 of the tape-bringing base plate 153 so as to be joined. Thus, the delivery frame 53 is secured such that vertical movement of the delivery frame 53 along the rear bending shaft 170*b* of the loop supply means 35 is inhibited.

Moreover, adjustment of the belt-loop sewing machine 2 is performed which includes positioning of the two cloth retainers 7 of the belt-loop sewing machine 2.

After the adjustment of the apparatus corresponding to the belt loop 20 has been completed, the power supply switch (not shown) provided for the operation panel 209 or the like is switched on. Thus, electric power is supplied to the belt-loop supply apparatus 31 and the belt-loop sewing machine 2. After electric power has been supplied to the belt-loop supply apparatus 31, the belt-loop sewing machine 2 and the belt-loop supply apparatus 31 perform initializing operations, called idle rotations, in accordance with predetermined programs stored in the operation control unit 220 of the memory 212 of the control means 210.

As a result of the initializing operation of the belt-loop supply apparatus 31, the origin of the tape drawing motor 114 is detected. Thus, the tape drawing means 38 is stopped at an operation reference position. The pair of the chucking arms 85 of the tape drawing means 38 are stopped at a predetermined operation reference position (see FIG. 16). The operation reference position for the pair of the chucking arms 85 must be more downstream in the direction of the delivery of the tape 12 than the chucking position (see FIG. 16) at which the pair of the chucking arms 85 hold and chuck the leading end of the tape 12. It is preferable that the operation reference position is a position at which the pair of the chucking arms 85 of the tape drawing means 38 do not interfere with the movement locus of the two-way forks 172 of the bending shafts 170. In this embodiment, it is preferable that the foregoing position is a position more downstream in the direction of the delivery of the tape 12 than the position to which the pair of the chucking arms 85 of the tape drawing means 38 have been moved rearwards to the belt-loop forming position after the chucking arms 85 have drawn out the tape 12 to the belt-loop forming position.

After the initializing operation of the 31 has been completed, a control command is issued from the control means 210 to each element. The air cylinder 98 for opening/closing the pair of the chucking arms 85 of the tape drawing means 38 is operated by the opening/closing operating electromagnetic valve 100. Thus, the air cylinder 98 holds the output shaft 98*a* at the rear end. Thus, the opened state is realized in which the chuck 93 of the movable arm 85*b* is positioned apart from the chuck 87 of the stationary arm 85*a*. Then, the tape drawing motor 114 for moving forwards/rearwards the pair of the chucking arms 85 of the tape drawing means 38 is stopped at the operation reference point. Therefore, the tape drawing motor 114 holds the pair of the chucking arms 85 at the operation reference position. The cutting-operation driving means 61 comprising the air cylinder for vertically moving the movable blade 34*a* of the tape cutting means 34 is operated by the cutting-operation driving electromagnetic valve 62. Thus, the cutting-operation driving means 61 holds the movable blade 34*a* at an upper position. The bent shaft driving means 197 for moving forwards/rearwards the pair of the bending shafts 170 and the tape bringing means 33 of the loop supply means 35 is operated by the bent shaft driving electromagnetic valve 198. Therefore, the bent shaft driving means 197 holds the pair of the bending shafts 170 and the tape bringing means 33 at the retraction position (see FIG. 1). The bending-operation driving means 173*a* and 173*b* for rotating the pair of the bending shafts 170 of the loop supply means 35 are operated by the bending-operation driving electromagnetic valves 190*a* and 190*b*. Thus, the bending-operation driving means 173*a* and 173*b* cause the two-way forks 172 of the pair of the bending shafts 170 to face vertically. As a result, the two-way forks 172 are held. The tape-bringing-operation driving means 149 for switching the tape bringing means 33 between the opened state and the holding state is operated by the tape-bringing-operation driving electromagnetic valve 151. Therefore, the tape-bringing-operation driving means 149 maintains the opened state in which the bringing pins 136 of the tape bringing means 33 are positioned at the upper front portion of the tape receiving surface 121 to enable the tape 12 to be placed on the tape receiving surface 121. The fullness-forming-operation driving means 158 for moving upwards the tape receiving surface 121 of the tape support member 120 having the function of the bending shafts 170 of the tape bringing means 33 to form a fullness is operated by the fullness-forming-operation driving electromagnetic valve 162. Thus, the fullness-forming-operation driving means 158 holds the tape receiving surface 121 at the leading end of the tape bringing means 33 at a lower position. At this time, the pair of the chucking arms 85 of the tape drawing means 38 are held at the operation reference position deviated from the movement locus of the loop supply means 35, as described above. Therefore, interference between the pair of the chucking arms 85 and the front bending shaft 170*a*, the bent shaft support member 176*a* and the bending-operation driving means 173*a* for supporting the leading end of the belt loop 20 to hold the end toward the central portion can reliably be prevented.

Then, the operator inputs information required to perform the sewing operation by using the operation panel 209, information including the length, for example, 40 mm, of the belt loop 20, the thickness of the tape 12, whether or not a fullness is formed, the size of the fullness when the fullness is formed, the number of the belt loops 20 which must be sewn to the sewn product S. Thus, the length of the belt loop 20 required to perform the sewing operation is stored in the memory 212 of the control means 210. Moreover, the program stored in the operation control unit 220 of the control means 210 calculates the number of steps, which is the amount of rotations of the tape delivery motor 44, and the number of steps, which is the amount of rotations of the tape drawing motor 114 to obtain the amount of the delivery of the tape 12 corresponding to the input length of the belt loop 20. Specifically, the program calculates the chucking position of the chucking arms 85 and the number of steps at the belt-loop forming position to store the results in the memory 212. Moreover, the thickness of the tape 12, whether or not the fullness is formed and the number of the belt loops 20 which must be sewn to the sewn product S are stored in the memory 212.

Then, the leading end of the tape 12 is inserted between the delivery roller 40 and the tape-delivery surface 47. Then, the start switch (not shown) provided for the operation panel 209 or the like is switched on so that the operation for supplying the tape 12 is started.

After the operation for supplying the tape 12 has been started, control commands are issued from the control means 210. As shown in FIG. 16, the tape drawing motor 114 forwards moves the pair of the chucking arms 85 of the tape cutting means 34 positioned at the operation reference position and brought to the opened state. Thus, the pair of the chucking arms 85 moves to the chucking position, which is the forward end position on the left side (in FIG. 16) of the movable blade 34*a* of the tape cutting means 34, which is indicated by an arrow B shown in FIG. 16 and which is a downstream position in the direction of the delivery of the tape 12. Then, the pair of the chucking arms 85 is stopped. Timing at which the pair of the chucking arms 85 is moved to the chucking position is required to be timing at which the pair of the chucking arms 85 reaches the chucking position after the tape 12 has been moved to the chucking position by the delivery roller 40. If the tape 12 and the pair of the chucking arms 85 simultaneously reach the chucking position, cycle time required to complete one tape supply operation can be shortened.

After the pair of the chucking arms 85 and the leading end of the tape 12 have been moved to the chucking position, a control command is issued from the control means 210 to the opening/closing operating electromagnetic valve 100. Thus, the opening/closing operating electromagnetic valve 100 is operated so that the output shaft 98*a* of the air cylinder 98 is moved forwards to the forward movement end. Then, the pair of the chucking arms 85 is closed. Thus, the two chucking portions 87 and 93 of the pair of the chucking arms 85 hold the leading end of the tape 12.

After the two chucking portions 87 and 93 of the pair of the chucking arms 85 have held the leading end of the tape 12, control commands are issued from the control means 210 to the tape delivery motor 44 and the tape drawing motor 114. Thus, the tape delivery motor 44 and the tape drawing motor 114 are operated. Thus, rotations of the delivery roller 40 for delivering the tape 12 and the operation for drawing the tape 12 by dint of the movement of the pair of the chucking arms 85 to the rearward position are simultaneously performed. After the pair of the chucking arms 85 has reached the belt-loop forming position, the leading end of the tape 12 reaches the belt-loop forming position. Then, the tape delivery motor 44 and the tape drawing motor 114 are stopped. At this time, the control means 210 determines whether or not the fullness is formed in accordance with information input to the memory 212. If a determination is made that no fullness is formed, the tape delivery motor 44 and the tape drawing motor 114 are rotated in quantities required to form the belt loop 20.

Then, a control command is issued from the control means 210 to the bent shaft driving electromagnetic valve 198. Thus, the bent shaft driving electromagnetic valve 198 is operated so that the bent shaft driving means 197 is operated. As a result, the tape bringing means 33 and the pair of the bending shafts 170 of the loop supply means 35 positioned at the retraction position are moved forwards to the loop folding position. Then, the leading ends of the pair of the bending shafts 170 are inserted into the tape 12. After the tape bringing means 33 and the loop supply means 35 have been moved to the loop folding position, the folding-position sensor 204 detects movement of the tape bringing means 33 and that of the loop supply means 35 to the loop folding position to transmit a detection signal to the control means 210. When the control means 210 has received the detection signal indicating the movement of the tape bringing means 33 and that of the loop supply means 35 to the loop folding position, the control means 210 issues a control command to the bent shaft driving electromagnetic valve 198. Thus, the bent shaft driving electromagnetic valve 198 is operated so that the operation of the bent shaft driving means 197 is interrupted. Thus, the tape bringing means 33 and the loop supply means 35 are held at the loop folding position. At this time, the tape bringing means 33 is in the opened state shown in FIG. 6. The lower surface of the substantially central portion of the tape 12 in the lengthwise direction of the tape 12 positioned at the belt-loop forming position is upwards supported by the tape receiving surface 121 of the tape support member 120 held at the loop folding position. The two lengthwise directional ends of the tape 12 positioned at the belt-loop forming position are held by the pair of the pins 171 constituting the pair of the two-way forks 172 of the loop supply means 35 held at the loop folding position. The locus of the vertical movement of each of the tape bringing means 33 and the leading end of the loop supply means 35 when the tape bringing means 33 and the loop supply means 35 are moved from the retraction position to the loop folding position can easily and appropriately be controlled by dint of the shape of the cam groove 192 provided for the movement locus limiting member 191 to which the roller 184 has been engaged.

After the tape bringing means 33 and the loop supply means 35 have been moved to the loop folding position, the control means 210 issues a control command to the tape-bringing-operation driving electromagnetic valve 151. Thus, the tape-bringing-operation driving electromagnetic valve 151 is operated so that the output shaft 149*a* of the tape-bringing-operation driving means 149 is moved to the end of the forward movement. As shown in FIG. 7, the bringing pins 136 bring the side surface of the tape 12 positioned on the tape receiving surface 121 into contact with the contact surface 122*a* of the positioning members 122. Then, the bringing pins 136 aligns the side surface. Moreover, the holding portion 131 of the tape holding member 130 serving as the tape holding means 166 presses the upper surface of the tape 12. Thus, a holding state in which the tape 12 is held is realized.

At this time, the link plate 144 is rotated because the output shaft 149*a* of the tape-bringing-operation driving means 149 has been moved forwards. Large component force in the horizontal direction for rearwards moving the tape bringing member 142 of the tape bringing means 33 along the elongated holes 126 acts in an initial stage of the rotation. Thus, force for driving the bringing pins 136 to approach the positioning members 122 provided for the tape receiving surface 121 of the tape support member 120 is large. That is, force for bringing the tape 12 is large. On the other hand, force for counterclockwise pivoting the tape brining member 142 about the bringing-board support shaft 127 to cause the holding portion 131 of the tape holding member 130 to approach the tape 12 is reduced. That is, component force in the vertical direction for pressing the tape 12 is reduced. In synchronization with the movement of the output shaft 149*a* of the tape-bringing-operation driving means 149 to the end of the forward movement, the component force of the tape bringing means 33 in the horizontal direction for rearwards moving the tape brining member 142 along the elongated holes 126 is reduced. Thus, force for causing the bringing pins 136 to approach the positioning members 122 provided for the tape receiving surface 121 of the tape support member 120 is reduced. When the output shaft 149*a* of the tape-bringing-operation driving means 149 has reached the end of the forward movement, force for causing the holding portion 131 of the tape holding member 130 to approach the tape 12 is maximized. That is, the component force in the vertical direction for pressing the tape 12 is maximized. As a result of the above-mentioned structure, the operation of the tape bringing means 33 for positioning the tape 12 and the operation of the holding portion 131 of the tape holding member 130 serving as the tape holding means 166 for holding the tape 12 can substantially simultaneously, easily and reliably be performed. As a result, the tape 12 can reliably be set to the loop supply means 35.

Then, the pair of the chucking arms 85 are opened so that the leading end of the tape 12 held by the pair of the chucking arms 85 is released. Thus, a control command is issued from the control means 210 to the cutting-operation driving electromagnetic valve 62. Thus, the cutting-operation driving electromagnetic valve 62 is operated so that the cutting-operation driving means 61 downwards moves the movable blade 34*a*. Then, the cutting-operation driving means 61 upwards moves the movable blade 34*a*. As a result, the base portion of the tape 12 is cut at the cutting position. Therefore, a belt loop 20 having a predetermined length is formed at the belt-loop forming position.

After the belt loop 20 has been formed by cutting the base portion of the tape 12, a control command is issued from the control means 210 to the bending-operation driving electromagnetic valves 190*a* and 190*b*. Thus, the bending-operation driving electromagnetic valves 190*a* and 190*b* are operated so that the bending-operation driving means 173*a* and 173*b* rotate the front bending shaft 170*a* and the rear bending shaft 170*b* by an angular degree of about 270°. As a result, the pair of the pins 171 of the two-way forks 172 are made to be substantially horizontal. Thus, the two ends of the belt loop 20 are held by the leading ends of the pair of the bending shafts 170 so as to be folded toward the central portion of the belt loop 20. As a result of the above-mentioned operation, the belt loop 20 is held at the belt-loop forming position in a state in which the two ends of the belt loop 20 are supported by the leading ends of the pair of the bending shafts 170 and the belt loop 20 are folded toward the central portion in the form of a predetermined shape. Thus, a state is realized in which the belt loop 20 can always be supplied to the sewing position.

This embodiment has a structure that the bending-operation driving means 173*a* and 173*b* are operated by the bending-operation driving electromagnetic valves 190*a* and 190*b*. However, a structure may be employed in which the bending-operation driving means 173*a* and 173*b* are operated by one bending-operation driving electromagnetic valve to meet design concept or the like, if necessary.

Then, the operator places the sewn product S, such as jeans, on the needle plate 6 of the belt-loop sewing machine 2, and then positions the sewn product S. After the sewn product S has been placed on the needle plate 6 of the belt-loop sewing machine 2, the body-part detection sensor 208 detects the sewn product S set on the needle plate 6 of the belt-loop sewing machine 2. Then, the body-part detection sensor 208 transmits a detection signal to the control means 210. Since the above-mentioned structure is employed, whether or not the sewn product S has been set on the sewing position of the belt-loop sewing machine 2 can easily be detected.

After the sewn product S has been placed on the needle plate 6 of the belt-loop sewing machine 2 and the body-part detection sensor 208 has transmitted the detection signal representing detection of the sewn product S to the control means 210, a control command is issued from the control means 210 to the bent shaft driving electromagnetic valve 198. Thus, the bent shaft driving electromagnetic valve 198 is operated so that the bent shaft driving means 197 is operated. As a result, the tape bringing means 33 and the pair of the bending shafts 170 of the loop supply means 35 positioned at the loop folding position are moved forwards to the temporal stop position in front of the sewing position for the belt loop 20 held at the belt-loop forming position, for example, to the position adjacent to the needles 5 of the belt-loop sewing machine 2.

At this time, the locus of movement of the leading ends of the tape bringing means 33 and the loop supply means 35 when the tape bringing means 33 and the loop supply means 35 are moved from the loop folding position to the temporal stop position, that is, the locus of the vertical movement of the belt loop 20 can easily and appropriately be controlled by dint of the shape of the cam groove 192 provided for the movement locus limiting member 191 to which the roller 184 has been engaged. Thus, undesirable contact with the hand of the operator can be prevented.

The temporal stop position may be a position above the side surface of the needle plate 6 of the belt-loop sewing machine 2.

After the belt loop 20 has been positioned at the temporal stop position, the temporary-stop-position sensor 206 detects the movement of the tape bringing means 33 and the loop supply means 35 to the temporal stop position so as to transmit a detection signal to the control means 210.

After the belt loop 20 has been moved to the temporal stop position, the body-part detection sensor 208 again detects whether or not the sewn product S exists. If the body-part detection sensor 208 transmits, to the control means 210, a detection signal representing a fact that the sewn product S does not exist, a control command is issued from the control means 210 to the bent shaft driving electromagnetic valve 198. Thus, the bent shaft driving electromagnetic valve 198 is operated so that the bent shaft driving means 197 is operated. As a result, the tape bringing means 33 and the pair of the bending shafts 170 of the loop supply means 35 holding the belt loop 20 at the temporal stop position are moved rearwards to the loop folding position. Thus, the belt loop 20 is returned to the belt-loop forming position.

If the body-part detection sensor 208 has transmitted, to the control means 210, a detection signal representing a fact that the sewn product S exists, the belt loop 20 is continuously held as the temporal stop position until the operator switches on the loop supply switch 207.

After the operator has completed by the operator for positioning the sewn product S and switched the loop supply switch 207 on, a control command is issued from the control means 210 to the bent shaft driving electromagnetic valve 198. Thus, the bent shaft driving electromagnetic valve 198 is operated so that the bent shaft driving means 197 is operated. As a result, the tape bringing means 33 and the pair of the bending shafts 170 of the loop supply means 35 are moved forwards. Thus, the belt loop 20 positioned at the temporal stop position is moved and supplied to the sewing position below the needles 5.

At this time, the supply-start-time learning portion 228A of the learning portion 228 stores time taken from a moment at which the body-part detection sensor 208 serving as the body-part detection means has detected a fact that the sewn product S has been set to the sewing position for the purpose of sewing the belt loop 20 to a moment at which supply of the belt loop 20 to the sewing position is completed by the operator by switching the loop supply switch 207. Thus, a next operation can be performed as follows: if the body-part detection sensor 208 serving as the body-part detection means for sewing a first belt loop 20 has detected setting of the sewn product S to the sewing position by the operator, the loop supply switch 207 is automatically switched on without a necessity of operating the loop supply switch 207. Thus, the belt loop 20 is automatically moved to the sewing position. That is, when the operator has set the sewn product S to the sewing position of the belt-loop sewing machine 2, the loop supply means 35 can automatically be operated at the operation timing for the operator without the necessity of operating the loop supply switch 207. Therefore, labor of the operator can be saved. The supply-start-time learning portion 228A of the learning portion 228 is able to learn the operation rhythm of the operator which is actually operating the belt-loop supply apparatus 31. Therefore, if another operator operates the apparatus, the operation rhythm of the operator operating the apparatus can reliably be learned.

If time taken to the moment at which the loop supply switch 207 is operated is, in ensuing operations, shorter than late time taken to the moment at which the loop supply switch 207 is operated, the loop supply means 35 is required to be operated for shortest time. As an alternative to this, an average value of periods of time taken to operate the loop supply switch 207 plural times may be used to operate the loop supply means 35.

The belt loop 20 is moved from the belt-loop forming position to the sewing position in a state in which the belt loop 20 is upwards supported by the tape receiving surface 121. Therefore, the shape of the belt loop 20 can reliably be maintained. When a fullness is formed, deformation of the shape of the fullness can reliably be prevented. Therefore, the shape of the belt loop 20 sewn to the sewn product S can reliably and appropriately be maintained. As a result, the quantity of the sewn product can reliably be improved.

After the belt loop 20 has been moved to the sewing position, the sewing-position sensor 205 detects movement of the tape bringing means 33 and the loop supply means 35 to the sewing position. Then, the sewing-position sensor 205 transmits a detection signal to the control means 210.

Then, the cloth retainers 7 of the belt-loop sewing machine 2 are moved downwards so that the two ends of the folded belt loop 20 are pressed against predetermined positions on the sewn product S.

After the two ends of the folded belt loop 20 have been pressed against the predetermined positions on the sewn product S, control commands are issued from the control means 210 to the opening/closing operating electromagnetic valve 100 and the bent shaft driving electromagnetic valve 198. Thus, the opening/closing operating electromagnetic valve 100 is operated so that the output shaft 98*a* of the air cylinder 98 is moved rearwards to the end of the rearward movement. Then, the pair of the chucking arms 85 are opened so that the belt loop 20 held by the pair of the chucking arms 85 is released. Moreover, the bent shaft driving electromagnetic valve 198 is operated so that the bent shaft driving means 197 is operated. As a result, the tape bringing means 33 and the pair of the bending shafts 170 of the loop supply means 35 are moved rearwards. Therefore, the two-way forks 172 of the pair of the bending shafts 170 are drawn from the two ends of the folded belt loop 20. Moreover, the tape receiving surface 121 of the tape bringing means 33 is drawn from the position between the sewn product S and the belt loop 20, and then moved to the retraction position and stopped at the retraction position.

After the two-way forks 172 and the tape receiving surface 121 have been drawn from the belt loop 20, the operator switches on the sewing start switch (not shown) so that the belt-loop sewing machine 2 is operated. Thus, the needles 5 are operated vertically. As a result, the two folded ends of the belt loop 20 are sewn to the sewn product S. The sewing operation which is performed by the belt-loop sewing machine 2 is performed such that the needle plate 6 is moved in direction XY in synchronization with the positions of the needles 5 in accordance with predetermined data for the sewing operation.

During the sewing operation of the belt-loop sewing machine 2, a belt loop 20 is formed which has a predetermined shape, which is used in a next sewing operation and in a state in which the two ends are held by the leading ends of the pair of the bending shafts 170 so as to be folded toward the central portion. Then, the new belt loop 20 is moved to the temporal stop position and held at the temporal stop position. Thus, a parallel process is performed such that the belt loop 20 can always be supplied to the sewing position.

After the first belt loop 20 has been sewn to the sewn product S, the sewn product S is moved on the needle plate 6. Then, the sewn product S to which a second belt loop 20 is sewn is positioned.

After the sewn product S to which the second belt loop 20 must be sewn has been positioned, the loop supply switch 207 is switched on by the operator. Thus, the second belt loop 20 is moved to the sewing position. Then, downward movement of the cloth retainers 7 of the belt-loop sewing machine 2, movement of the tape bringing means 33 and the loop supply means 35 to the retraction position, the sewing operation and the parallel process are sequentially performed as described above. Thus, the second belt loop 20 is sewn to a predetermined position of the sewn product S.

At this time, the operation-distance learning portion 228B of the learning portion 228 stores a period of time taken from a moment at which the operator has switched on the loop supply switch 207 for the purpose of sewing the first belt loop 20 to the sewn product S. The period of time is taken to a moment at which supply of the second belt loop 20 to the sewing position such that the operator has switched on the loop supply switch 207 for the purpose of supplying the second belt loop 20 to the sewing position is completed. The supply of the second belt loop 20 is performed in a state in which the body-part detection sensor 208 serving as the body-part detection means has detected setting of the sewn product S to the sewing position for the purpose of sewing a plurality of belt loops 20 to the sewn product S. Thus, following processes can be performed with a necessity of operating the loop supply switch 207. Thus, the loop supply switch 207 is automatically switched on so that the belt loop 20 is automatically moved to the sewing position.

Therefore, when the operator has moved the sewn product S on the needle plate 6, the loop supply means 35 can automatically be operated at the operation timing of the operator without a necessity of operating the loop supply switch 207. Thus, labor of the operator can be saved. The operation-distance learning portion 228B of the learning portion 228 is able to learn the operation rhythm of the operator operating the belt-loop supply apparatus 31. Therefore, the operation rhythm of the operator can reliably be learned if another operator operates the belt-loop supply apparatus 31.

If time taken to the moment at which the loop supply switch 207 is operated is, in ensuing operations, shorter than a later time taken to the moment at which the loop supply switch 207 is operated, the loop supply means 35 is required to be operated for the shortest time. As an alternative to this, an average value of periods of time taken to operate the loop supply switch 207 plural times may be used to operate the loop supply means 35.

If the function of the learning portion 228 has caused the belt loop 20 to be moved to the sewing position below the needles 5 when the sewn product S is positioned, a structure having a speed-control unit or the like to control the moving speed of the loop supply means 35 may be employed. In this case, the belt loop 20 can smoothly be moved from the belt-loop forming position to the sewing position without a necessity of stopping at the temporal stop position. Appropriate control of the moving speed of the belt loop 20 realizes a state free from an obstacle when the sewn product S is positioned. Therefore, sewn product S can easily be positioned.

Specifically, for example, the learning portion 228 stores time taken from detection of setting of the sewn product S at the sewing position by the body-part detection sensor 208 to depression of the belt loop 207. In an initial state, the pair of the bending shafts 170 is in a standby state in which the pair of the bending shafts 170 is holding the belt loop 20. After the body-part detection sensor 208 has confirmed setting of the sewn product S and the loop supply switch 207 has been depressed, the pair of the bending shafts 170 is moved to the sewing position to perform sewing. When a next sewn product S has been set, the body-part detection sensor 208 confirms the sewn product S. Thus, the pair of the bending shafts 170 is moved to the sewing position before the loop supply switch 207 is depressed. The moving speed at this time is calculated from time taken from detection of setting of the sewn product S by the body-part detection sensor 208 to depression of the loop supply switch 207. Control is performed such that the loop supply switch 207 is depressed to perform the sewing operation simultaneously with arrival of the pair of the bending shafts 170 at the sewing position.

Figure 18:
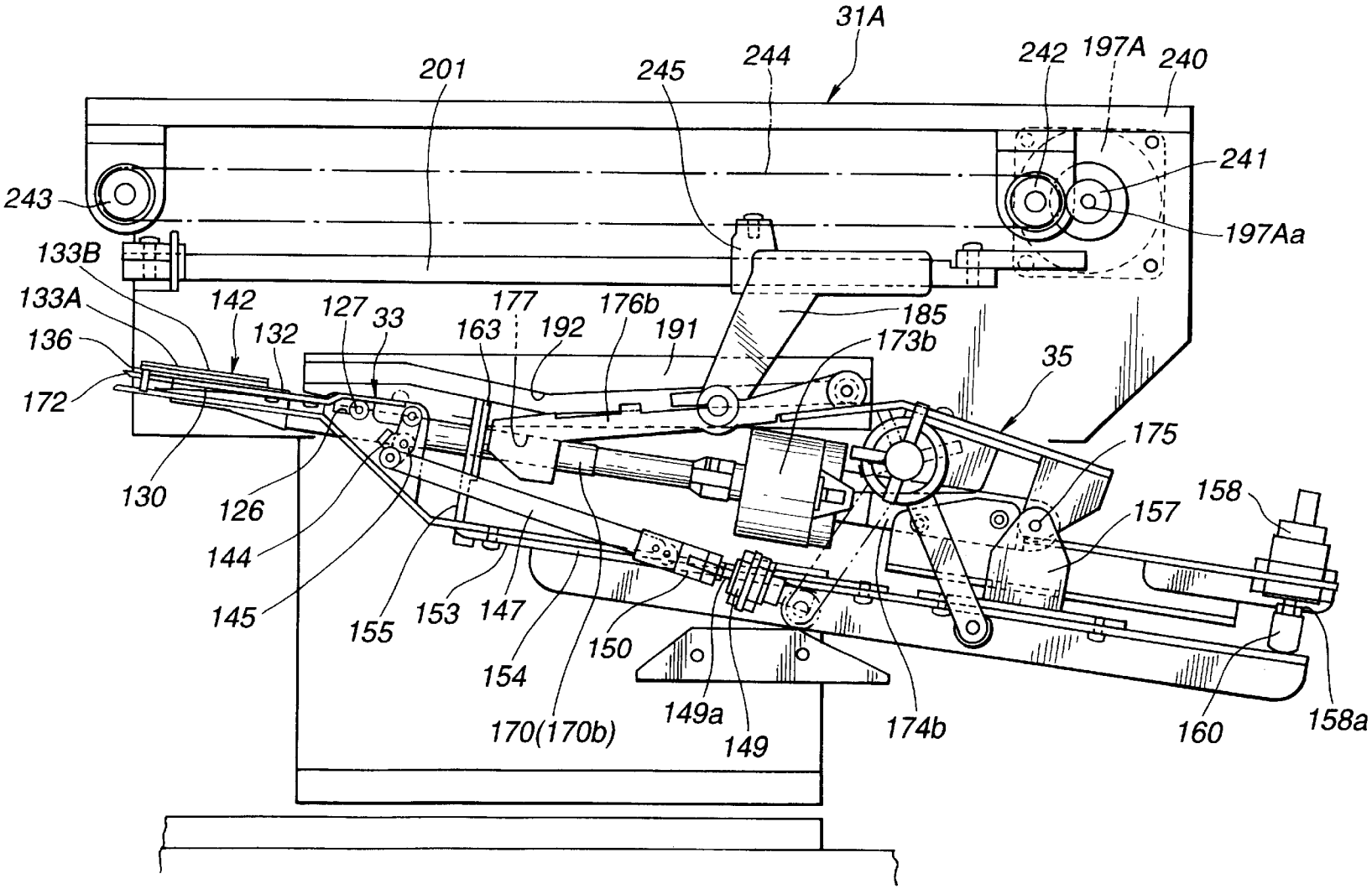
FIG. 18 is an enlarged front view showing an essential portion of a portion including a bent shaft moving means of the belt-loop supply apparatus according to a fifth embodiment of the present invention.
Figure 19:
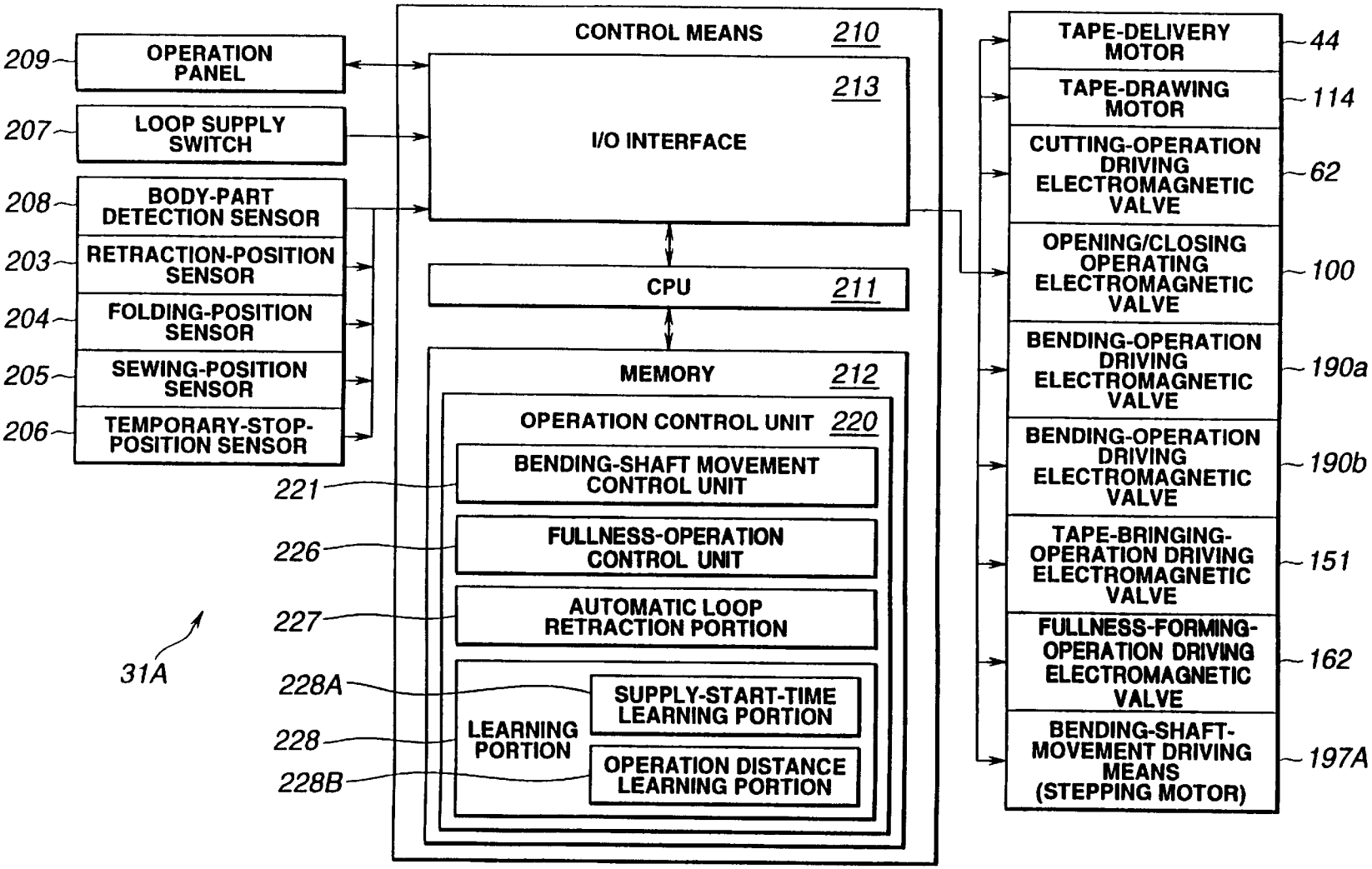
FIG. 19 is a block diagram showing a control means of the belt-loop supply apparatus according to the fifth embodiment of the present invention.
Figure 20:
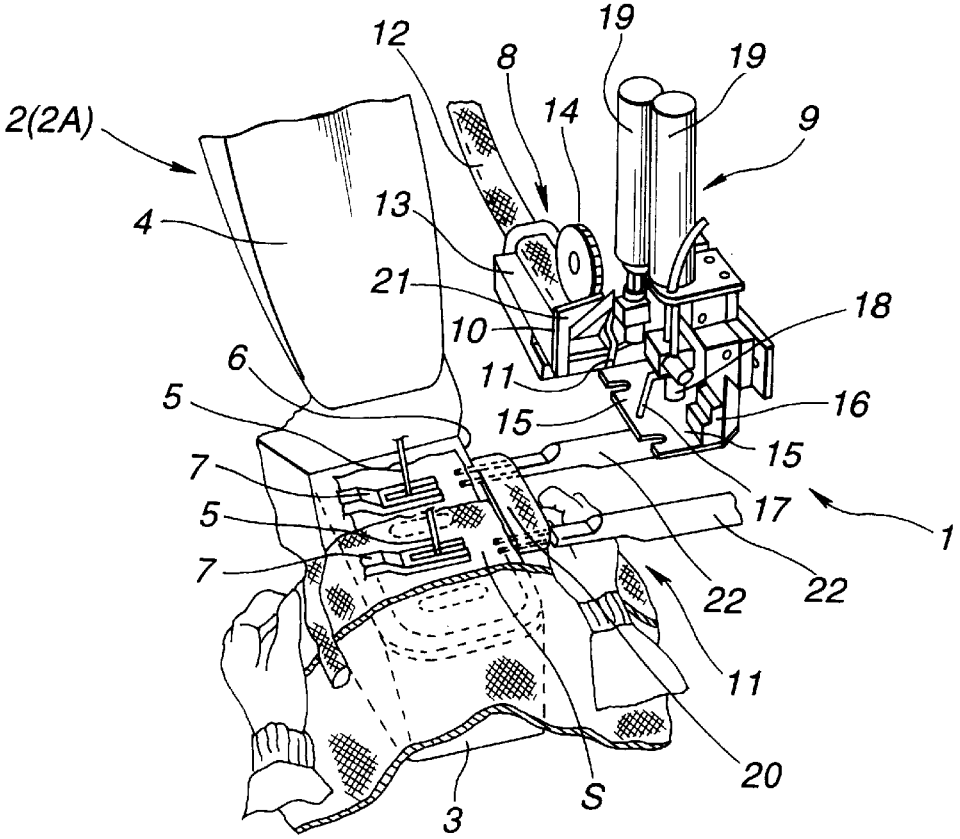
FIG. 20 is a perspective view showing an essential portion of an example of a belt-loop supply apparatus of a conventional machine for sewing a belt loop.
Figure 21:
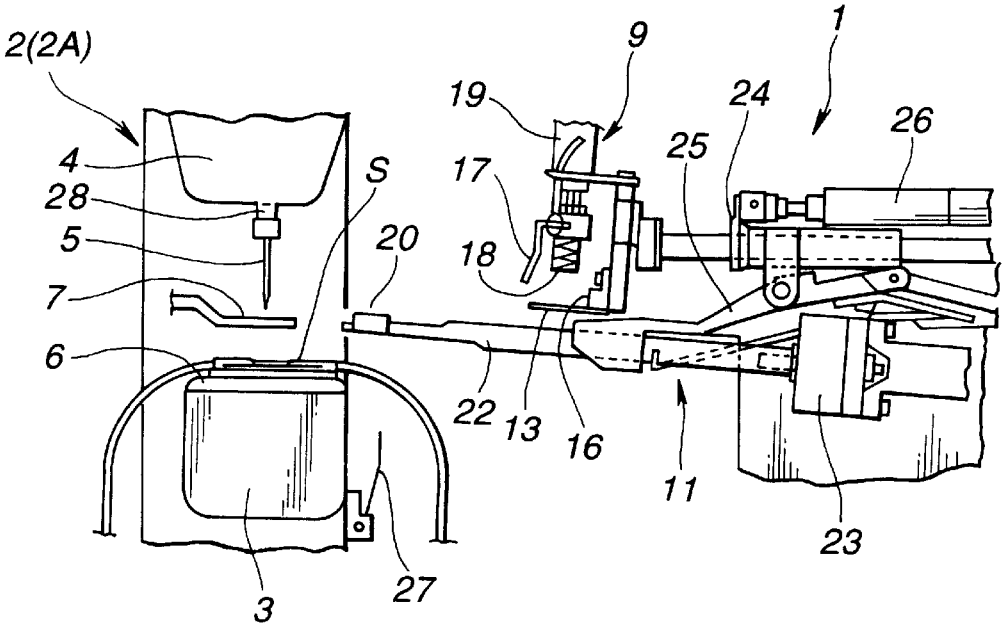
FIG. 21 is a front view of FIG. 20.
Figure 22:
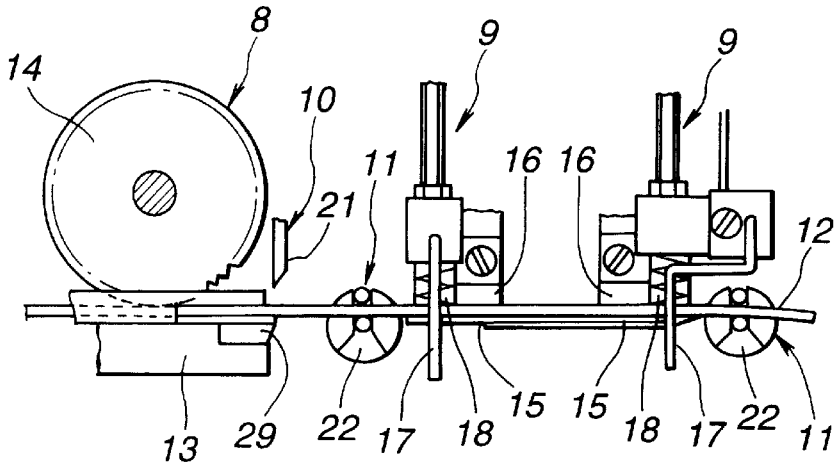
FIG. 22 is a diagram showing a state in which a tape is supplied by the belt-loop supply apparatus shown in FIG. 20.
Figure 23:
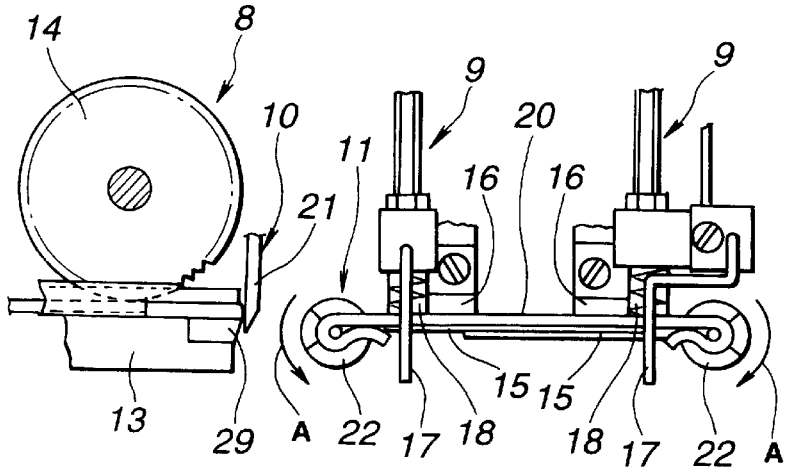
FIG. 23 is a diagram showing a state in which the tape has been cut by the belt-loop supply apparatus shown in FIG. 20 to form a belt loop, followed by bending the two ends of the belt loop toward the central portion of the belt loop.
Figure 24:
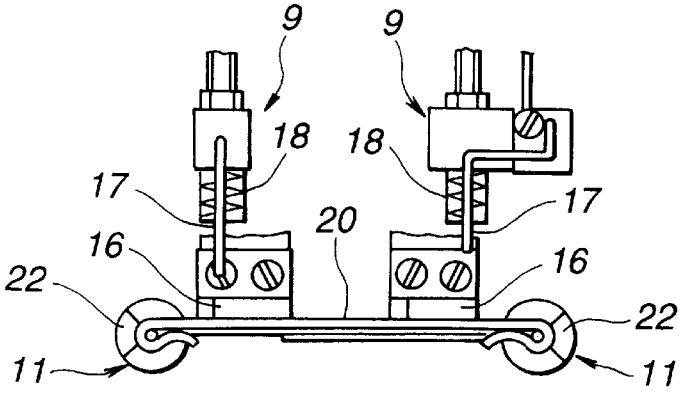
FIG. 24 is a diagram similar to FIG. 22 showing a state in which holding of the belt loop by the belt-loop supply apparatus shown in FIG. 20 has been suspended.

FIGS. 18 and 19 show a second embodiment of the belt-loop supply apparatus according to the present invention. FIG. 18 is an enlarged front view showing an essential portion of a portion including the bent shaft driving means. FIG. 19 is a block diagram showing the control means.

A belt-loop supply apparatus 31A has a structure that a bent shaft driving means 197A is substituted for the bent shaft driving means 197 according to the first embodiment and comprising a three-stage air cylinder for moving forwards/rearwards the tape bringing means 33 and the loop supply means 35 of the belt-loop supply apparatus 31. The other structures are similar to those of the belt-loop supply apparatus 31 according to the first embodiment. Therefore, only an essential portion relating to the bent shaft driving means 197A of the belt-loop supply apparatus 31A according to the present invention will now be described. The other structures are omitted from description. The same or similar elements are given the same reference numerals and the same or similar elements are omitted from description.

As shown in FIG. 18, the belt-loop supply apparatus 31A according to this embodiment incorporates the bent shaft driving means 197A comprising a stepping motor for moving forwards/rearwards the tape bringing means 33 and the loop supply means 35. The bent shaft driving means 197A is joined to a mount 240 such that its output shaft 197Aa faces upwards. A drive gear 241 is joined to the output shaft 197Aa of the bent shaft driving means 197A. The drive gear 241 is engaged to a toothed drive belt pulley 242 rotatively supported by the mount 240. The toothed drive belt pulley 242 forms a pair with a rotating follower toothed belt pulley 243 supported by the mount 240 such that the rotating follower toothed belt pulley 243 is positioned apart from the toothed drive belt pulley 242 for a predetermined distance. A toothed belt 244 called a timing belt is arranged between the toothed drive belt pulley 242 and the rotating follower toothed belt pulley 243. The movable base 185 incorporating an appropriate movement-base securing member 245 is secured to a position of the toothed belt 244.

As shown in FIG. 19, the bent shaft driving means 197A comprising the stepping motor is, in place of the bent shaft driving electromagnetic valve 198, electrically connected to the I/O interface 213 of the control means 210. A control command is issued from the control means 210 to the bent shaft driving means 197A.

The belt-loop supply apparatus 31A structured as described above has an effect similar to that obtainable from the belt-loop supply apparatus 31 according to the first embodiment. The bent shaft driving means 197A comprising the stepping motor is able to easily stop the loop supply means 35 at an arbitrary position. Moreover, the moving speed of the loop supply means 35 can easily be changed. Therefore, when the speed at which the belt loop 20 is moved from the belt-loop forming position to the temporal stop position is reduced, obstruction caused from the belt loop 20 when the sewn product S is positioned at the sewing position of the belt-loop sewing machine 2 can reliably be prevented. Thus, the working efficiency and safety of the operation can be improved. Even if the learning portion 228 is not provided, the belt loop 20 can smoothly be moved from the belt-loop forming position to the sewing position without a necessity of stopping the belt loop 20 at the temporal stop position.

Moreover, the speed at which the belt loop 20 is moved from the temporal stop position to the sewing position can be raised. Thus, cycle time for supplying the belt loop 20 to the sewing position can easily be shortened. As a result, the working efficiency can be improved.

Since the moving speed of the loop supply means 35 can be easily be decelerated immediately before stoppage, a fear of the operator can be prevented.

As compared with the bent shaft driving means 197 comprising the air cylinder which is operated by the bent shaft driving electromagnetic valve 198, the bent shaft driving means 197A comprising the stepping motor is free from great noise, such as impact sound or operation sound when the operation is started or stopped. Therefore, the environment for the operation can easily be improved.

The belt-loop supply apparatus 31A according to this embodiment is able to easily change the number of operation steps of the bent shaft driving means 197A comprising the stepping motor to stop the loop supply means 35 at an arbitrary position. Therefore, the position of the belt loop 20 which must be positioned at the sewing position can easily be adjusted. As a result, if the width of the belt loop 20 is changed, sewing of the belt loop 20 and offset sewing of the belt loop 20 can easily be performed without a necessity of changing the distance from the loop supply means 35 to the sewing position.

The bent shaft driving means 197A is not limited to the stepping motor. An electronic control motor, such as a servo motor, may be employed which is capable of controlling the moving speed and the position to which the loop supply means 35 is moved.

The present invention is not limited to the above-mentioned embodiments. If necessary, a variety of modification may be permitted.

As described above, the belt-loop supply apparatus according to the present invention has the bent shaft control unit which is able to easily raise the moving speed of the bending shaft. Moreover, the speed immediately before stoppage of the bending shaft can easily be decelerated. As a result, the working efficiency can be improved. Moreover, great sound, such as impact sound and operation sound, can be prevented, driving the environment for the operation to easily be improved.

The bent shaft control unit is able to stop the bending shaft at an arbitrary position. Therefore, the position of the belt loop when the belt loop has been supplied to the sewing position of the belt-loop sewing machine can easily be adjusted. As a result, sewing of the belt loop and offset sewing of the belt loop can easily be performed without a necessity of changing the distance from the loop supply means to the sewing, that is, without a necessity of changing the position of the loop supply means if the width of the belt loop is changed.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A belt-loop supply apparatus incorporating:

tape supply means which is capable of supplying to a tape cutting position, an elongated tape for forming a belt loop;

tape cutting means for cutting the tape supplied to the tape cutting position to form a belt loop having a predetermined length;

belt loop supply means incorporating a part of bending members for holding two ends of the belt loop cut, bending the two ends of the belt loop toward the central portion of the belt loop and supplying the belt-loop, said belt-loop supply apparatus comprising:

movement control means for chainging moving speed of the belt loop supply means to move the bending members to a sewing position of a machine.

2. A belt-loop supply apparatus according to claim 1, wherein said moving means temporarily stops said bending member at a predetermined position on a passage formed from a position at which the belt loop is bent to the sewing position of the machine.

3. A belt-loop supply apparatus according to claim 1, wherein said moving means moves said bending member from the bending position to the predetermined position at low speed and moves the bending member at high speed from the predetermined position to the sewing position of the machine.

4. A belt-loop supply apparatus according to claim 1, wherein said moving means includes a stepping motor.

5. A belt-loop supply apparatus according to claim 1, wherein said moving means includes a servo motor.

6. A belt-loop supply apparatus incorporating:

tape supply means which is capable of supplying, to a tape cutting position, an elongated tape for forming a belt loop;

tape cutting means for cutting the tape supplied to the tape cutting position to form a belt loop having a predetermined length; and belt loop supply means incorporating a pair of bending shafts having a holding portion for holding two ends of the cut belt loop so as to be pivoted about the axis thereof so that two ends of the belt loop are bent toward the central portion of the belt loop and moved in an axial direction so that the belt loop is supplied to the sewing position of a machine; said belt-loop supply apparatus comprising:

movement control means joined to said bending shafts and for changing moving speed of said bending shafts in the axial direction.

7. A belt-loop supply apparatus according to claim 6, wherein said moving means moves, at low speed, said bending shafts from the bending position to the predetermined position in the axial direction and moves, at high speed, said bending shafts from the predetermined position to the sewing position of the machine.

8. A belt-loop supply apparatus according to claim 6, wherein said moving means includes a stepping motor.

9. A belt-loop supply apparatus according to claim 6, wherein said moving means includes a servo motor.

10. A belt-loop supply apparatus incorporating:

tape supply means which is capable of supplying, to a tape cutting position, an elongated tape for forming a belt loop;

tape cutting means for cutting the tape supplied to the tape cutting position to form a belt loop having a predetermined length; and belt loop supply means incorporating a pair of bending shafts having a holding portion for holding two ends of the cut belt loop so as to be pivoted about the axis thereof so that two ends of the belt loop are bent toward the central portion of the belt loop and moved in an axial direction so that the belt loop is supplied to the sewing position of a machine, said belt-loop supply apparatus comprising:

movement control means joined to said bending shafts for controlling moving speed of said bending shafts in the axial direction such that said bending shafts are stopped at an arbitrary position after movement of said bending shafts.

11. A belt-loop supply apparatus according to claim 10, wherein the arbitrary position is the sewing position of the machine.

12. A belt-loop supply apparatus according to claim 10, wherein said moving means is a stepping motor.

13. A belt-loop supply apparatus according to claim 10, wherein said moving means is a servo motor.

* * * * *